US011045969B2

(12) United States Patent
Knaupp et al.

(10) Patent No.: US 11,045,969 B2
(45) Date of Patent: Jun. 29, 2021

(54) CATCHER TANK ASSEMBLY OF WATERJET CUTTING SYSTEM

(75) Inventors: Michael Knaupp, Zaisenhausen (DE); Andreas Meyer, Neibsheim (DE); Steven J. Craigen, Auburn, WA (US); Robert J. Mann, Puyallup, WA (US); Mohamed A. Hashish, Bellevue, WA (US); Eckhardt R. Ullrich, Kent, WA (US); Thomas R. Loofbourow, Tacoma, WA (US)

(73) Assignee: Flow International Corporation, Kent, WA (US)

( * ) Notice: Subject to any disclaimer, the term of this patent is extended or adjusted under 35 U.S.C. 154(b) by 849 days.

(21) Appl. No.: 13/193,435

(22) Filed: Jul. 28, 2011

(65) Prior Publication Data

US 2013/0025425 A1 Jan. 31, 2013

(51) Int. Cl.

| | |
|---|---|
| ***B26F 3/00*** | (2006.01) |
| ***B26D 7/01*** | (2006.01) |
| ***B65D 88/00*** | (2006.01) |

(52) U.S. Cl.

CPC ..... *B26F 3/008* (2013.01); *B65D 88/005* (2013.01); *B26D 7/01* (2013.01); *B26F 3/004* (2013.01);

(Continued)

(58) Field of Classification Search

CPC ..... B26F 3/004; B26F 3/008; B65D 88/005; B65D 88/10

See application file for complete search history.

(56) References Cited

U.S. PATENT DOCUMENTS 1,389,553 A * 8/1921 Hyman ..... C02F 3/28 138/42

1,402,744 A 1/1922 Deck (Continued)

FOREIGN PATENT DOCUMENTS

DE 9202023 U1 4/1992
EP 0270364 A1 6/1988

(Continued)

OTHER PUBLICATIONS

Drawings of catcher tank assembly for waterjet cutting machine, sold by Flow International Corporation at least as early as Jan. 2010, 4 pages.

*Primary Examiner* — Clark F Dexter
(74) *Attorney, Agent, or Firm* — Cozen O'Connor

(57) ABSTRACT

A catcher tank assembly is provided for a waterjet cutting machine. The catcher tank assembly includes a catcher tank having a plurality of tank sections detachably coupleable together in a side-by-side manner to collectively define a catcher tank having a desired configuration. The catcher tank assembly further includes a workpiece support system detachably coupleable to an interior cavity of the catcher tank. The workpiece support system may include a plurality of workpiece support modules arrangeable in an array to support a workpiece platform of the waterjet cutting machine. The workpiece platform may be formed, for example, by a series of slats supported transversely to parallel rows of the workpiece support modules. Methods and systems which relate to or include the aforementioned catcher tank assembly are also provided.

41 Claims, 13 Drawing Sheets

(52) U.S. Cl.
CPC ..... *Y10T 29/49826* (2015.01); *Y10T 83/364* (2015.04)

(56) References Cited

U.S. PATENT DOCUMENTS

| | | | | | |
|---|---|---|---|---|---|
| 2,134,678 | A | * | 10/1938 | Billig et al. | B64D 37/02 220/563 |
| 2,228,779 | A | * | 1/1941 | Pavlecka et al. | B63B 3/68 220/681 |
| 2,373,221 | A | | 4/1945 | Blaylock et al. | |
| 2,402,253 | A | * | 6/1946 | Macleod | B65D 90/08 220/4.17 |
| 2,537,219 | A | * | 1/1951 | Girton | A01J 7/02 220/4.16 |
| 2,592,419 | A | | 4/1952 | Harper et al. | |
| 2,685,964 | A | | 8/1954 | Brown | |
| 3,043,465 | A | | 7/1962 | Horner | |
| 3,193,847 | A | | 7/1965 | Mashura | |
| 3,877,334 | A | * | 4/1975 | Gerber | B26D 7/018 83/169 |
| 3,927,591 | A | * | 12/1975 | Gerber | 83/177 |
| 4,204,448 | A | * | 5/1980 | Pearl | 83/177 |
| 4,234,379 | A | | 11/1980 | Conway et al. | 162/145 |
| 4,331,252 | A | | 5/1982 | Carren et al. | 220/5 A |
| 4,457,441 | A | | 7/1984 | McCloughan | 220/5 A |
| 4,463,639 | A | * | 8/1984 | Gerber | B26D 7/20 83/177 |
| 4,656,791 | A | | 4/1987 | Herrington et al. | 51/410 |
| 5,092,829 | A | * | 3/1992 | Gerber | A41H 43/02 227/67 |
| 5,127,199 | A | | 7/1992 | Blankers et al. | 51/425 |
| 5,163,793 | A | | 11/1992 | Martinez | 409/205 |
| 5,193,714 | A | * | 3/1993 | Carey | B65D 90/24 220/4.26 |
| 5,643,058 | A | | 7/1997 | Erichsen et al. | 451/99 |
| 6,095,025 | A | * | 8/2000 | Mirabello | B26D 7/20 269/289 R |
| 6,375,547 | B1 | | 4/2002 | Massenburg | 451/38 |
| 6,634,928 | B2 | | 10/2003 | Erickson et al. | 451/40 |
| 7,069,875 | B2 | * | 7/2006 | Warecki | A01K 5/01 119/228 |
| 7,584,947 | B2 | | 9/2009 | Freeland | 269/296 |
| 7,775,854 | B1 | | 8/2010 | Boman et al. | 451/8 |
| 7,866,642 | B2 | | 1/2011 | McAllister | 269/37 |
| 8,308,019 | B2 | * | 11/2012 | Paterson et al. | H01M 10/12 220/681 |
| 2006/0084364 | A1 | * | 4/2006 | Toncelli | B28D 1/003 451/5 |
| 2009/0064832 | A1 | * | 3/2009 | Caretta et al. | B23K 26/0093 83/76.7 |
| 2009/0140482 | A1 | | 6/2009 | Saberton et al. | 269/296 |
| 2010/0219185 | A1 | | 9/2010 | Griffin et al. | 220/4.07 |

FOREIGN PATENT DOCUMENTS

| | | | | |
|---|---|---|---|---|
| GB | 530725 | * | 12/1940 | |
| GB | 552057 | * | 3/1943 | B65D 88/10 |
| GB | 1 596 293 | * | 8/1981 | B65D 88/10 |
| WO | WO 2007/042905 A1 | | 4/2007 | |

* cited by examiner 12
130
134
132
49
132
122
132
84
47
44
40
47
42
122
123
66
126
124
48
86
126
66
126
124
120
124
126
124
126
124
126

CATCHER TANK ASSEMBLY OF WATERJET CUTTING SYSTEM

BACKGROUND

Technical Field

This disclosure relates to a catcher tank assembly of a waterjet cutting system, and in some embodiments, is directed to a catcher tank assembly having a particularly versatile form factor to enable the construction of catcher tank assemblies of divergent sizes and capabilities.

Description of the Related Art

High-pressure fluid jets, including high-pressure abrasive waterjets, are used to cut a wide variety of materials in many different industries. Systems for generating high-pressure waterjets and abrasive waterjets (collectively "waterjets") are currently available, such as, for example, the Mach 4™ 5 axis waterjet system manufactured by Flow International Corporation, the assignee of the present invention. Other examples of waterjet cutting systems are shown and described in Flow's U.S. Pat. No. 5,643,058, which is incorporated herein by reference in its entirety. In such systems, high-pressure fluid, typically water, flows through an orifice in a cutting head to form a high-pressure jet, into which abrasive particles can be combined as the jet flows through a mixing tube. The high-pressure abrasive waterjet is discharged from the mixing tube and directed toward a workpiece to cut the workpiece along a designated path.

Workpieces are generally supported on a platform or held by a fixture for processing by the high-pressure jet. During processing of the workpiece, some energy of the high-pressure waterjet is absorbed by the workpiece itself while other energy is absorbed by a volume of water underlying, partially submerging or completely submerging the workpiece. A catcher tank is typically provided to hold water for this purpose. Conventional catcher tanks include unitary steel weldments having integral support structures for supporting a workpiece platform. Conventional catcher tanks are robust structures which can be particularly burdensome to fabricate and/or transport, and which are limited in their ability to adapt to changing conditions and new applications.

BRIEF SUMMARY

Embodiments described herein provide catcher tank assemblies and waterjet cutting systems having particularly versatile form factors to enable the construction of catcher tank assemblies and waterjet cutting systems of divergent sizes and capabilities. Components of the catcher tank assemblies may include modular units to facilitate shipment and enhance assembly of the catcher tank and related systems.

In one embodiment, a catcher tank assembly for a waterjet cutting machine may be summarized as including a catcher tank having a plurality of tank sections detachably coupleable together in a side-by-side manner to collectively define an internal tank cavity. The catcher tank assembly may further include a workpiece support system detachably coupleable to the catcher tank within the internal tank cavity. The workpiece support system may be formed of a plurality of workpiece support modules arrangeable in an array to support a workpiece platform when the catcher tank assembly is assembled. The workpiece platform may include, for example, a series of slats, mesh plates or other structures that form an upper work surface of the tank upon which a workpiece may be supported for processing.

The catcher tank may be configured such that a first row of the array of workpiece support modules is detachably coupleable to a first tank section and a second row of the array of workpiece support modules is detachably coupleable to a second tank section. The tank sections of the catcher tank may include two tank end units and an intermediate tank unit, wherein the end tank units are configured to detachably couple together to form a first tank configuration and detachably couple to opposing sides of the intermediate tank unit to form a second tank configuration. Each of the plurality of tank sections of the catcher tank may include a floor, opposing sidewalls and a flange extending across one of the opposing sidewalls, along the floor and across the other one of the opposing sidewalls to define a u-shaped mating interface for selectively assembling the tank sections in the side-by-side manner.

Each of the tank sections of the catcher tank may include an upstanding flange offset from an abutment edge, and the catcher tank may further include a cord configured to be compressibly disposed between the upstanding flanges of two adjacent tank sections when the two adjacent tank sections are coupled together. The abutment edges of the two adjacent tank sections may be configured to cooperatively control a degree of compression of the cord. The catcher tank may further include at least one spacer configured to be disposed between the upstanding flanges of the two adjacent tank sections to control a degree of compression of the cord. When two adjacent tank sections are coupled together, the abutment edges, the upstanding flanges and the at least one spacer may combine to define a box-like cavity to captively receive the cord.

The workpiece support system may further include a plurality of adjustment devices for selectively leveling the workpiece support modules when the workpiece support system is in an assembled configuration. The workpiece support system may further include a plurality of elongated support columns detachably coupleable to a floor of the catcher tank to support the workpiece support modules at a height above the floor. Adjacent sets of the elongated support columns may be configured to support opposing ends of a respective workpiece support module when the workpiece support system is in an assembled configuration. At least one set of the elongated support columns may support an end of each of two adjacent workpiece support modules when the workpiece support system is in an assembled configuration. When the workpiece support system is in an assembled configuration, a load capacity of the elongated support columns supporting a first one of the workpiece support modules may be at least twice the load capacity of the elongated support columns supporting a second one of the workpiece support modules.

The catcher tank assembly may further include a waste removal system, the waste removal system configured to span an interface between adjacent tank sections to transport a flushing fluid from a first one of the tank sections to at least a second one of the tank sections. The waste removal system may include a plurality of nozzles configured to generate flushing jets directed into areas of each of the plurality of tank sections. When the catcher tank assembly is in the assembled configuration, a first set of the nozzles in one region of the catcher tank may be selectively operable independent of a second set of the nozzles in another region of the catcher tank. The catcher tank assembly may further include a water level control system at least partially integrated into one of the tank sections, the water level control system configured to selectively control a height of the volume of water in the catcher tank during the cutting operation. The catcher tank may include a plurality of armor plates detachably coupled to interior sidewalls thereof.

According to another embodiment, a waterjet cutting system may be summarized as including a catcher tank and a cutting head movably coupled to a multi-axis machine and operable to process a workpiece via a cutting operation. The catcher tank is configured to hold a volume of water for absorbing the energy of a jet generated by the cutting head of the waterjet cutting machine during the cutting operation, and includes a plurality of tank sections detachably coupled together in a side-by-side manner to collectively define an internal tank cavity. The waterjet cutting system may further include a workpiece support system detachably coupled to the catcher tank, the workpiece support system including a plurality of workpiece support modules arranged in an array to support a workpiece platform on which to support the workpiece during the cutting operation. The tank sections of the catcher tank may include two tank end units coupled together in an abutting relationship or at least one intermediate tank unit sandwiched between tank end units.

According to another embodiment, a method of constructing a catcher tank may be summarized as including: detachably coupling a plurality of tank sections together in a side-by-side manner to form a catcher tank which collectively defines an internal tank cavity to hold a volume of water for absorbing energy of a jet generated by the waterjet cutting machine during a cutting operation; and detachably coupling a workpiece support structure to the catcher tank such that a plurality of workpiece support modules are arranged in an array to support a workpiece platform on which to support a workpiece to be processed during the cutting operation.

The method may include detachably coupling two tank end units together in an abutting relationship or sandwiching at least one intermediate tank unit between tank end units. The method may further include compressing a cord between adjacent tank sections. Detachably coupling a workpiece support structure to the catcher tank may include coupling a first row of the array of workpiece support modules to a first tank section and coupling a second row of the array of workpiece support modules to a second tank section. The method may further include attaching a plurality of elongated support columns to a floor of the catcher tank to support the workpiece support modules at a height above the floor with adjacent sets of the elongated support columns positioned to support opposing ends of a respective workpiece support module. The method may further include leveling the workpiece support modules such that the workpiece platform is substantially level.

DETAILED DESCRIPTION

Figure 1:
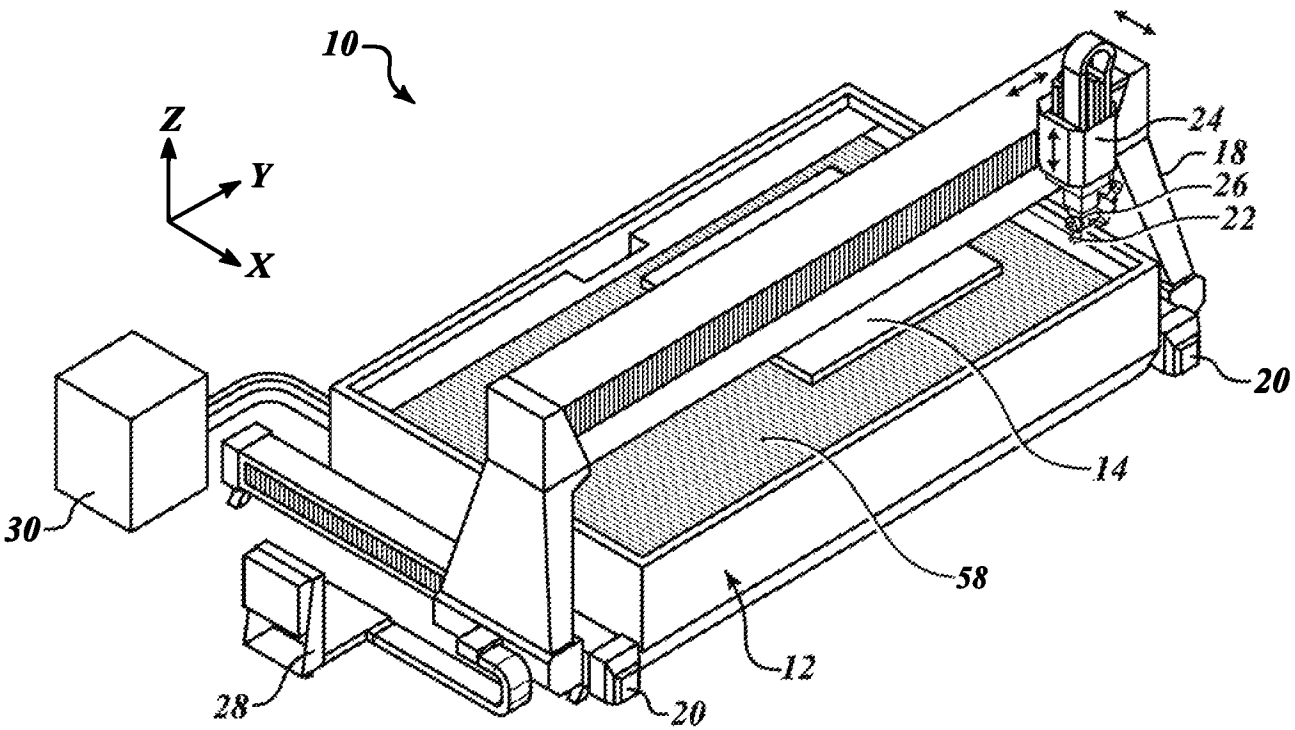
FIG. 1 is an isometric front view of a waterjet cutting system having a catcher tank assembly, according to one embodiment.

In the following description, certain specific details are set forth in order to provide a thorough understanding of various disclosed embodiments. However, one of ordinary skill in the relevant art will recognize that embodiments may be practiced without one or more of these specific details. In other instances, well-known structures associated with waterjet systems and catcher tank assemblies may not be shown or described in detail to avoid unnecessarily obscuring descriptions of the embodiments. For instance, it will be appreciated by those of ordinary skill in the relevant art that a high-pressure fluid source and an abrasive source may be provided to feed high-pressure fluid and abrasives, respectively, to a cutting head of the waterjet system to facilitate high-pressure abrasive waterjet cutting of workpieces supported by the catcher tank assemblies described herein. As another example, well known control systems and drive components may be integrated into the waterjet cutting system to facilitate movement of the cutting head relative to the workpiece to be processed. As still yet another example, it will be appreciated by those of ordinary skill in the relevant art that conventional welding techniques and conventional fastening devices (e.g., threaded bolts of appropriate grade and size) may be employed to construct the various embodiments of the catcher tank catcher tank assemblies described herein. In addition, it will be appreciated by those of ordinary skill in the relevant art that a variety of materials may be used for the various components described herein, such as, for example, metals, plastics and composites of different strengths, grades and other material properties, based on numerous design factors including, for example, operating and loading conditions.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Embodiments described herein provide catcher tank assemblies and waterjet cutting systems having particularly versatile form factors to enable the construction of catcher tank assemblies and waterjet cutting systems of divergent sizes and capabilities. Components of the catcher tank assemblies may include modular units to facilitate transport and enhance assembly of the catcher tank and related systems.

Figure 2:
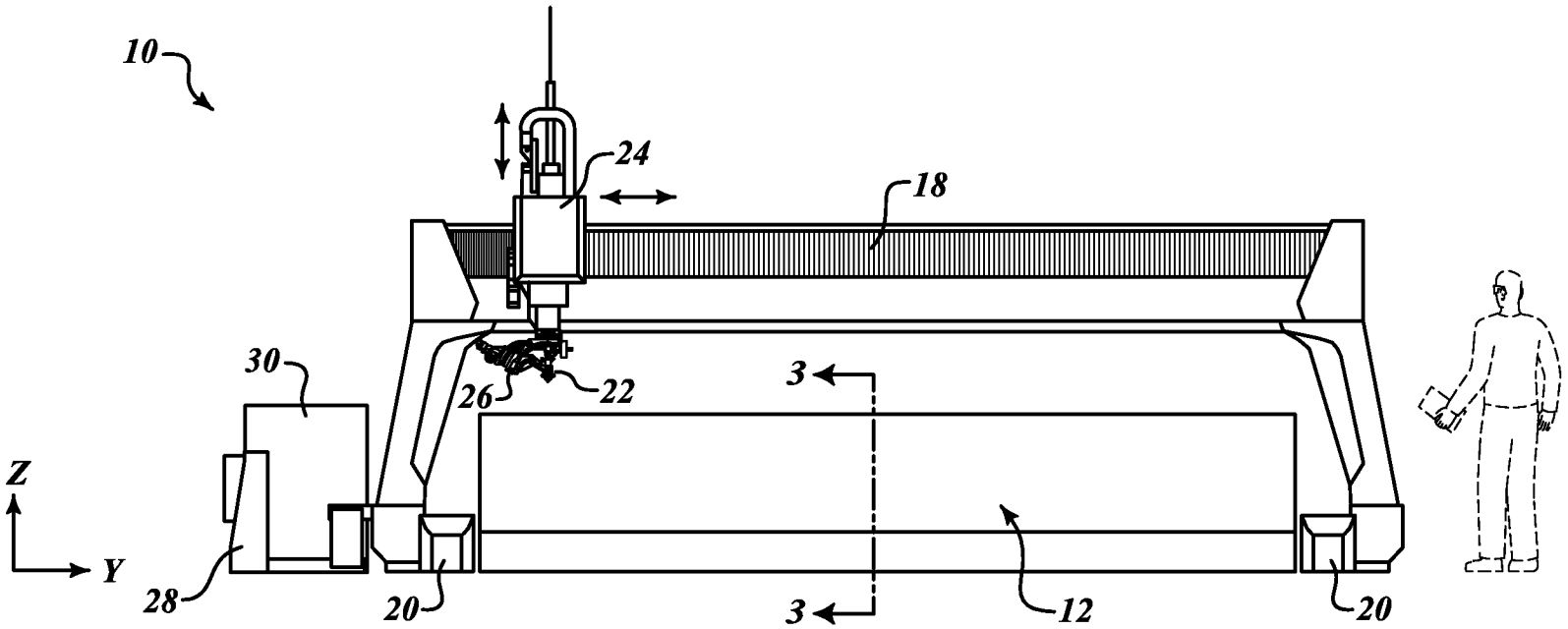
FIG. 2 is a side elevational view of the waterjet cutting system of FIG. 1.

FIGS. 1 and 2 show an example embodiment of a waterjet cutting system 10. The waterjet cutting system 10 includes a catcher tank assembly 12 which is configured to support a workpiece 14 to be processed by the system 10. The waterjet cutting system 10 further includes a bridge assembly 18 which is movable along a pair of base rails 20 and straddles the catcher tank assembly 12. In operation, the bridge assembly 18 moves back and forth along the base rails 20 with respect to a translational axis X to position a cutting head 22 of the system 10 for processing the workpiece 14. A tool carriage 24 is movably coupled to the bridge assembly 18 to translate back and forth along another translational axis Y, which is aligned perpendicularly to the translational axis X. The tool carriage 24 is further configured to raise and lower the cutting head 22 along yet another translational axis Z to move the cutting head 22 toward and away from the workpiece 14. An articulated wrist 26 is provided to adjust an orientation of the cutting head 22 relative to the workpiece 14 to enable processing of the workpiece 14 along particularly complex tool paths and tool orientations. During operation, movement of the cutting head 22 with respect to each of the translational axes X, Y, Z and axes of the articulated wrist 26 may be accomplished by various conventional drive components and an appropriate control system 28.

A waste removal system 30 may be coupled to the catcher tank assembly 12 to receive and process waste collected from the interior of the catcher tank assembly 12 during operation. Other well known systems associated with waterjet cutting machines may also be provided such as, for example, a pump for supplying high-pressure fluid to the cutting head 22 and/or an abrasive hopper for feeding abrasives to the cutting head 22 to enable abrasive waterjet cutting. These other well known systems, however, are not shown or described in detail to avoid unnecessarily obscuring descriptions of the embodiments.

Figure 3:
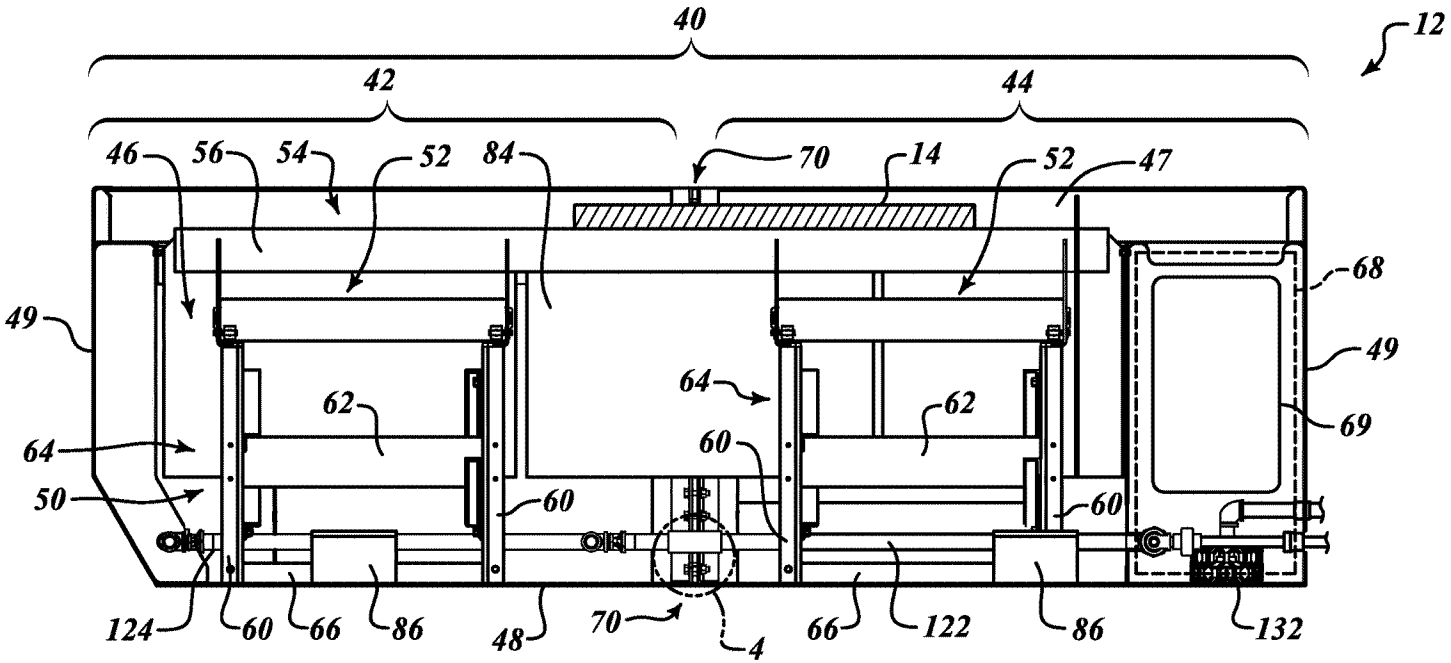
FIG. 3 is a cross-sectional view of the catcher tank assembly of the waterjet cutting system of FIG. 1 taken along line 3-3 of FIG. 2.

Further details of the catcher tank assembly 12 of the example embodiment are shown in FIG. 3. As shown in FIG. 3, the catcher tank assembly 12 includes a catcher tank 40 formed of tank sections 42, 44 detachably coupleable together in a side-by-side manner to collectively define an internal tank cavity 46. In some embodiments, the tank sections 42, 44 each include opposing sidewalls 47, a floor 48 extending therebetween and an end wall 49 to collectively define each end tank section or unit 42, 44. In embodiments having only two tank sections 42, 44, such as the example embodiment illustrated in FIG. 3, the tank end sections 42, 44 combine in an abutting relationship to collectively define the internal tank cavity 46. In other embodiments, the catcher tank 40 may include one, two or more intermediate tank sections 43 (FIG. 7) between the catcher tank end sections or units 42, 44.

The catcher tank assembly 12 further includes a workpiece support system 50 detachably coupleable to the catcher tank 40 within the internal tank cavity 46. The workpiece support system 50 may be formed in some embodiments to include a plurality of workpiece support modules 52 arrangeable in an array to support a workpiece platform 54 when the catcher tank assembly 12 is fully assembled. The workpiece platform 54 can include a series of slats 56, mesh plates, grates or other structures that form an upper work surface 58 of the workpiece platform 54 of the catcher tank 40 upon which the workpiece 14 may be supported for processing. The workpiece support modules 52 may be supported at a height above the floor 48 of the catcher tank 40 by one or more underlying support structures 64. In the illustrated embodiment of FIG. 3, for example, the workpiece support modules 52 are supported on each of opposing ends by elongated support columns 60 joined together by a cross member 62 to form a general H-shaped support structure 64. The H-shaped support structures 64 are removably coupled at one end to upstanding flanges 66 protruding from the floor 48 of the catcher tank 40 and are removably coupled at the other end to the workpiece support modules 52. Collectively, the support structures 64 and the workpiece support modules 52 form a comprehensive support system for the workpiece platform 54.

The catcher tank assembly 12 may include at least one tank section 44 having a dedicated region or volume 68 for optional accessories of the waterjet cutting system 10. For example, in one embodiment, the tank section 44 may include a region 68 adjacent the end wall 49 sized to contain therein a water level control system 69 to control a height of the volume of water within the internal cavity 46 of the catcher tank 40 during operation. In some embodiments, the region 46 may be sized to hold a bladder of the water level control system 69 having a capacity of at least 250 gallons, for example, to selectively raise and lower the water level at least four inches. In this manner, the water level in the catcher tank 40 may be quickly adjusted to maintain the water level just below the workpiece to be processed or at a level to partially submerge or completely submerge the workpiece during a cutting operation. This can advantageously reduce operating noise and enable cleaner cuts. The region 68 may also contain, in some embodiments, components of the waste removal system 30 when the catcher tank assembly 12 is provided with such a system, including, for example, waste pickups 132 and portions of a conduit routing system 122.

As shown in FIG. 3, the tank sections 42, 44 combine along a mating interface 70 to form the catcher tank 40.

Figure 4:
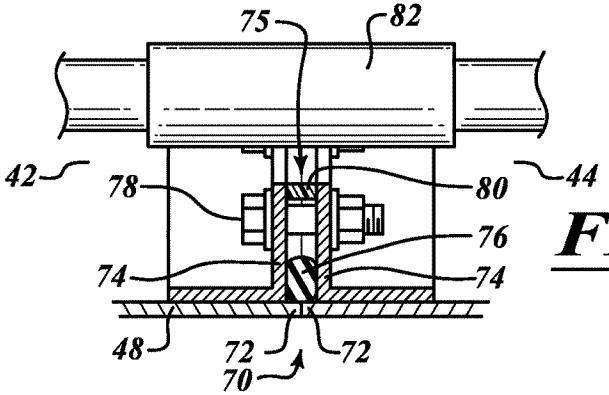
FIG. 4 is a partial detail view of the cross-section of the catcher tank assembly of FIG. 3 showing a mating interface of adjacent tank sections of the catcher tank assembly.
Figure 5:
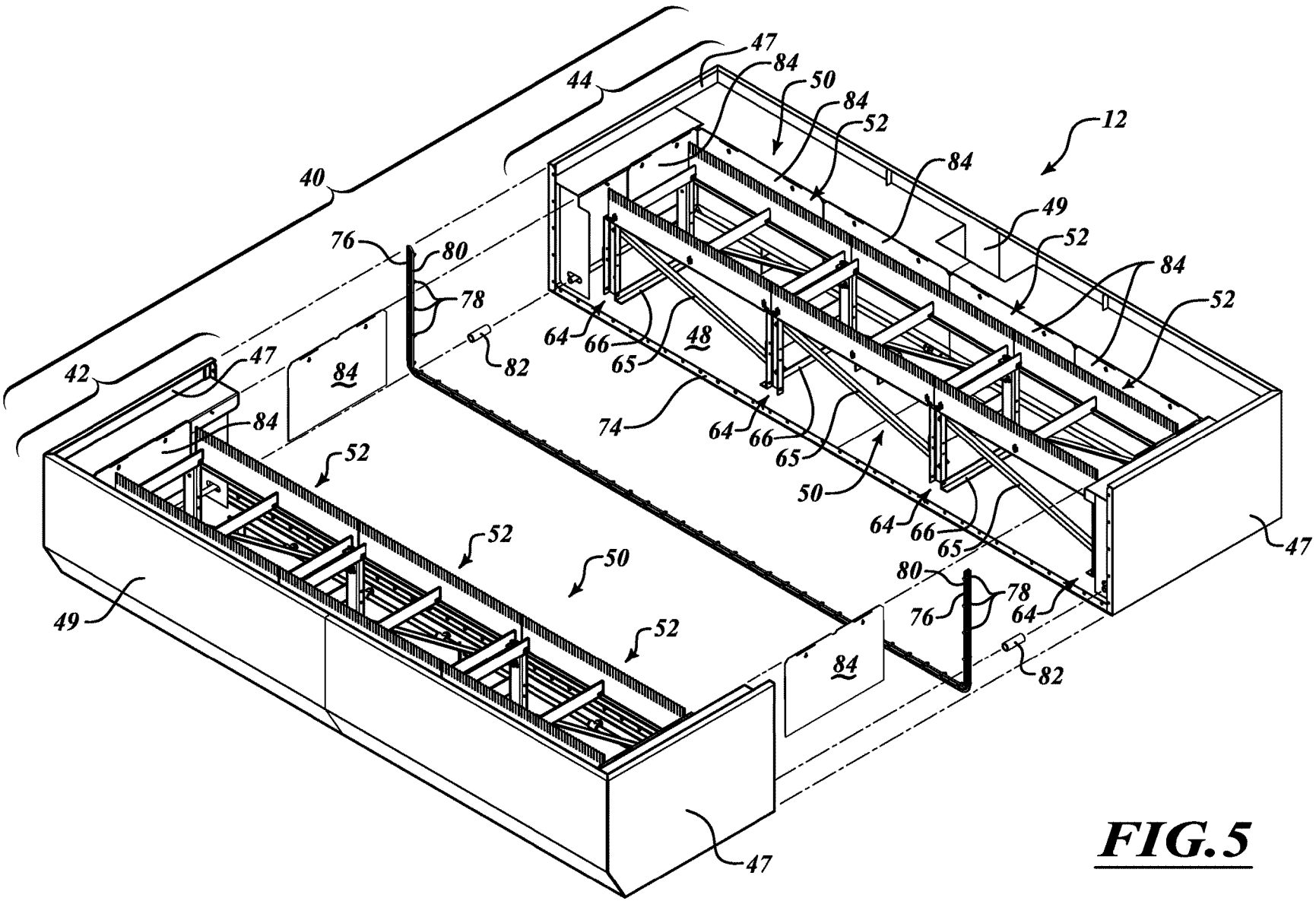
FIG. 5 is an isometric partially exploded view of the catcher tank assembly of the waterjet cutting system of FIG. 1 with a workpiece platform entirely removed to reveal workpiece support modules of a workpiece support system of the catcher tank assembly.

Further details of the mating interface are shown in FIGS. 4 and 5. For instance, with reference to FIG. 4, the tank sections 42, 44 of the example embodiment each include an abutment edge 72 for abutting an adjacent tank section 42, 44 during assembly. Each of the tank sections 42, 44 further includes an upstanding flange 74 offset from the respective abutment edge 72 to form a channel 75 between the abutting tank sections 42, 44. A cord 76 or other sealing device may be positioned between the adjacent flanges 74 of the tank sections 42, 44 within this channel 75 to create a water tight seal as the tank sections 42, 44 are urged together. The tank sections 42, 44 may be urged together, for example, via a plurality of threaded fastener assemblies 78 or other fastening devices. The cord 76 may be selected to deform by a predetermined amount as the tank sections 42, 44 are drawn together during assembly. A degree of compression of the cord 76 may be controlled, for example, by the abutment edges 72 coming into contact with each other. In addition, a spacer 80 may be positioned between the flanges 74 to control the degree of compression.

In some embodiments, when the two adjacent tank sections 42, 44 are coupled together, the abutment edges 72, the upstanding flanges 74 and the spacer 80 combine to define a box-like cavity to captively receive the cord 76. In this manner, the degree of the compression and effectiveness of the seal between the tank sections 42, 44 can be controlled by the structure of the tank sections 42, 44 interoperating with each other and the spacer 80. In addition, the cord 76 or other seal device may be protected by the spacer 80 from an overhead environment that could otherwise deteriorate the seal during operation. The box-like structure of the example embodiment thus provides a sealing mechanism that is particularly robust and reliable. Of course, it is appreciated that other sealing arrangements may be used in connection with the tank sections 42, 44, such as, for example, a generally planar gasket or gaskets between directly abutting faces of the tank sections 42, 44. The illustrated seal arrangement characterized by the enclosed box-like structure, however, performs exceptionally well in a relatively compact form factor. This is particularly the case when providing threaded fastener assemblies 78 in regular intervals (e.g., six inch intervals) along the entire length of the mating interface 70, as shown best in FIG. 5.

FIG. 5 further illustrates the mating interface 70 of the catcher tank assembly 12 in a partially assembled configuration. As can be appreciated from FIG. 5, the mating interface 70 may traverse the entire height of one sidewall 47 of the catcher tank 40, the entire length of the floor 48 and the entire height of the opposing sidewall 47 to form a generally u-shape mating interface 70. The cord 76 or other seal device and the spacer 80 are received between the tank sections 42, 44 at this mating interface 70 and compressed therebetween to form the fluid tight seal. In some embodiments, apart from conduit couplings 82 and optional armor plates 84 which may span the mating interface 70 when the catcher tank assembly 12 is fully assembled, the catcher tank assembly 12 may otherwise be free of components spanning over the mating interface 70. In this manner, the catcher tank assembly 12 may include substantially completed subassemblies that may be transported in a substantially complete form and assembled in a particularly efficient manner.

Devices to facilitate transfer of the tank sections 42, 44 or substantially completed subassemblies including the tank sections 42, 44 may be provided. For example, pockets 86 (FIGS. 3, 15 and 16) spaced to receive the tines of a forklift may be integrated into the floor 48 of each of the tank section 42, 44. The tank sections 42, 44 may also include eyelets, lugs or other features (not shown) for interfacing with lifting devices such as an overhead crane to transport or manipulate the tank sections 42, 44 during assembly.

Figure 7:
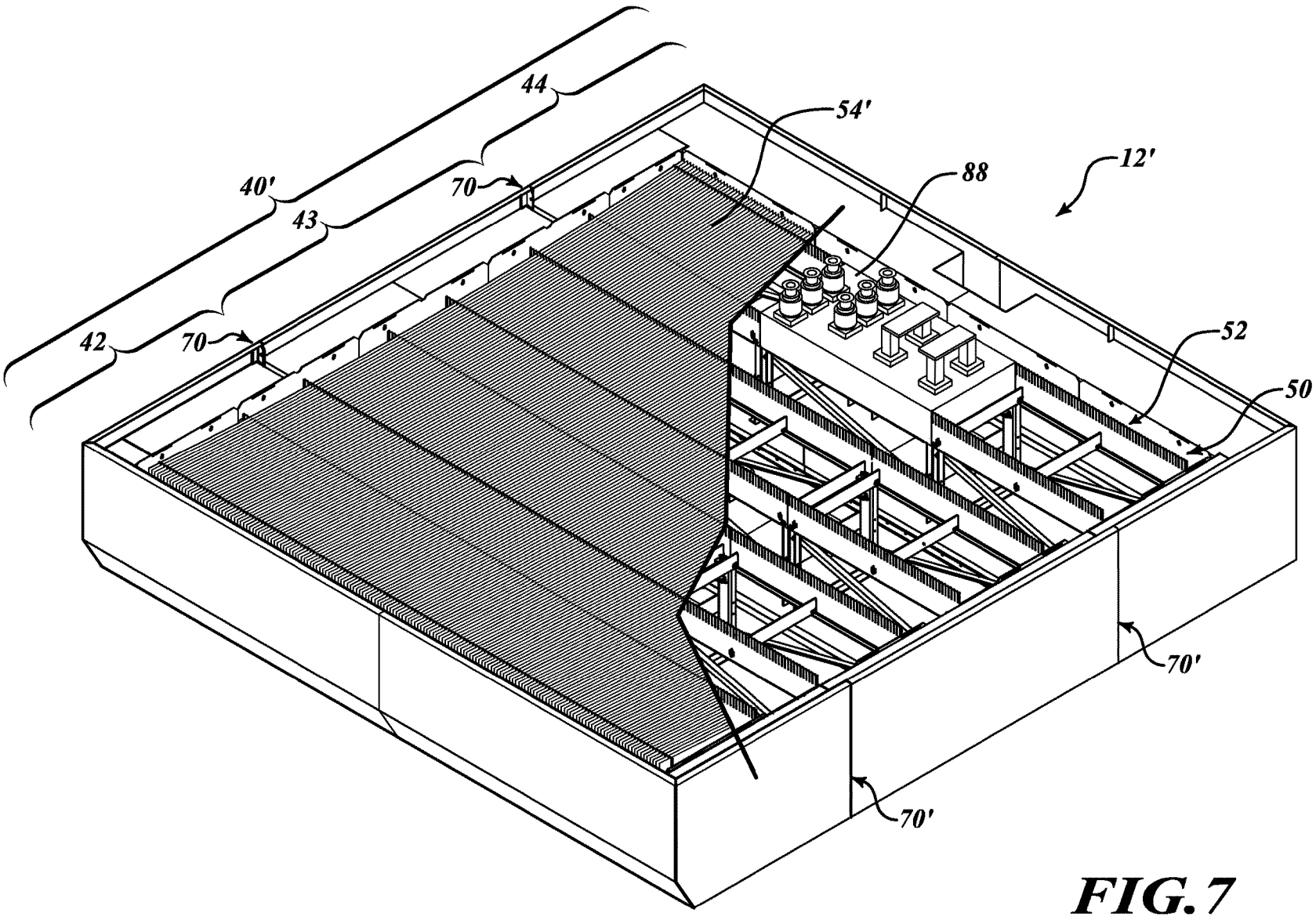
FIG. 7 is an isometric view of a catcher tank assembly, according to another embodiment, including an intermediate tank section received between opposing end tank units.

As shown in FIG. 5, the workpiece support system 50 may include a first set of workpiece support modules 52 arranged in a row within one of the tank sections 42 and a second set of workpiece support modules 52 arranged in a row within the other tank section 44. Accordingly, each tank section 42, 44 may be transported with a respective row of workpiece support modules 52 coupled thereto for subsequent assembly, or alternatively, may be transported without the workpiece support modules 52 and assembled together prior to receiving the workpiece support modules 52. In addition, as discussed in further detail elsewhere, one or more of the workpiece support modules 52 may be replaced with workpiece support modules having different load capacities, such as the relatively higher capacity workpiece support modules 52' described further below with reference to FIG. 13. In addition, the workpiece support modules 52 may be replaced with specialized workpiece fixtures 88, such as, for example, the specialized workpiece fixture 88 illustrated in FIG. 7 which includes actuators and stationary supports to support a workpiece for subsequent processing. Further details of work support features that may be included in a specialized workpiece fixture 88 can be found in Flow's U.S. Patent Application Publication No. 2009/0140482, which is incorporated herein by reference in its entirety. In still other embodiments, the workpiece support modules 52 may be omitted altogether. In this manner, the catcher tank assembly 12 provides a particularly versatile system which can be selectively configured to accommodate a wide range of processing activities, including, for example, the cutting of relatively thick, heavy substrates (e.g., steel plates having a thickness of 6 inches or more) supported on relatively higher capacity workpiece modules 52" (FIG. 13) or the cutting of complex or irregular workpieces (e.g., an aircraft fuselage) supported by specialized fixtures 88 (FIG. 7).

As further shown in FIG. 5, the workpiece support modules 52 may be supported at opposing ends thereof by the support structures 64. In addition, one support structure 64 may be arranged to support an end of each of two adjacent workpiece support modules 52. In this manner, the number of support structures 64 for each row of workpiece support modules 52 may be one more than the number of modules 52. This advantageously provides a particularly efficient workpiece support system 50 which is scalable. In addition, because the support structures 64 provide a common attachment or support area for adjacent workpiece support modules 52, the support structures 64 can assist in maintaining a particularly level, planar workpiece platform 54 (FIG. 6) by providing a common attachment area for otherwise independent components.

Each of adjacent sets of the support structures 64 may be removably coupled together by one or more cross members 65. The cross members 65 may be, for example, stock angle iron, bars, plates or other structural members having a variety of shapes. As discussed earlier, the support structures 64 may be removably coupled to the floor 48 of the catcher tank 40, such as, for example, by bolting the support structures 64 to upstanding flanges 66. The upstanding flanges 66 may be, for example, stock angle iron welded or otherwise secured to the floor 48. The support structures 64 are also removably coupled to the workpiece support modules 52. In this manner, the workpiece support modules 52, support structures 64 and cross members 65 can be broken down and setup quickly and efficiently to reconfigure the workpiece support system 50 within the interior of the catcher tank 40 and thereby adjust or adapt to changing conditions. For instance, the waterjet cutting system 10 may be used to process a first type or class of workpieces (e.g., lightweight, planar materials) in one application and then be reconfigured with different support structures 64' or specialized fixtures to process a second type or class of workpieces (e.g., heavy slab materials or substrates having complex curved surfaces) in another application. For example, a relatively higher capacity support structure 64' having, for example, thicker or more rigid support columns 60' may be provided as discussed in more detail further below with reference to FIG. 13. As another example, in some embodiments, the support structure 64 may include more support columns 60 (e.g., six or more support columns 60).

Figure 6:
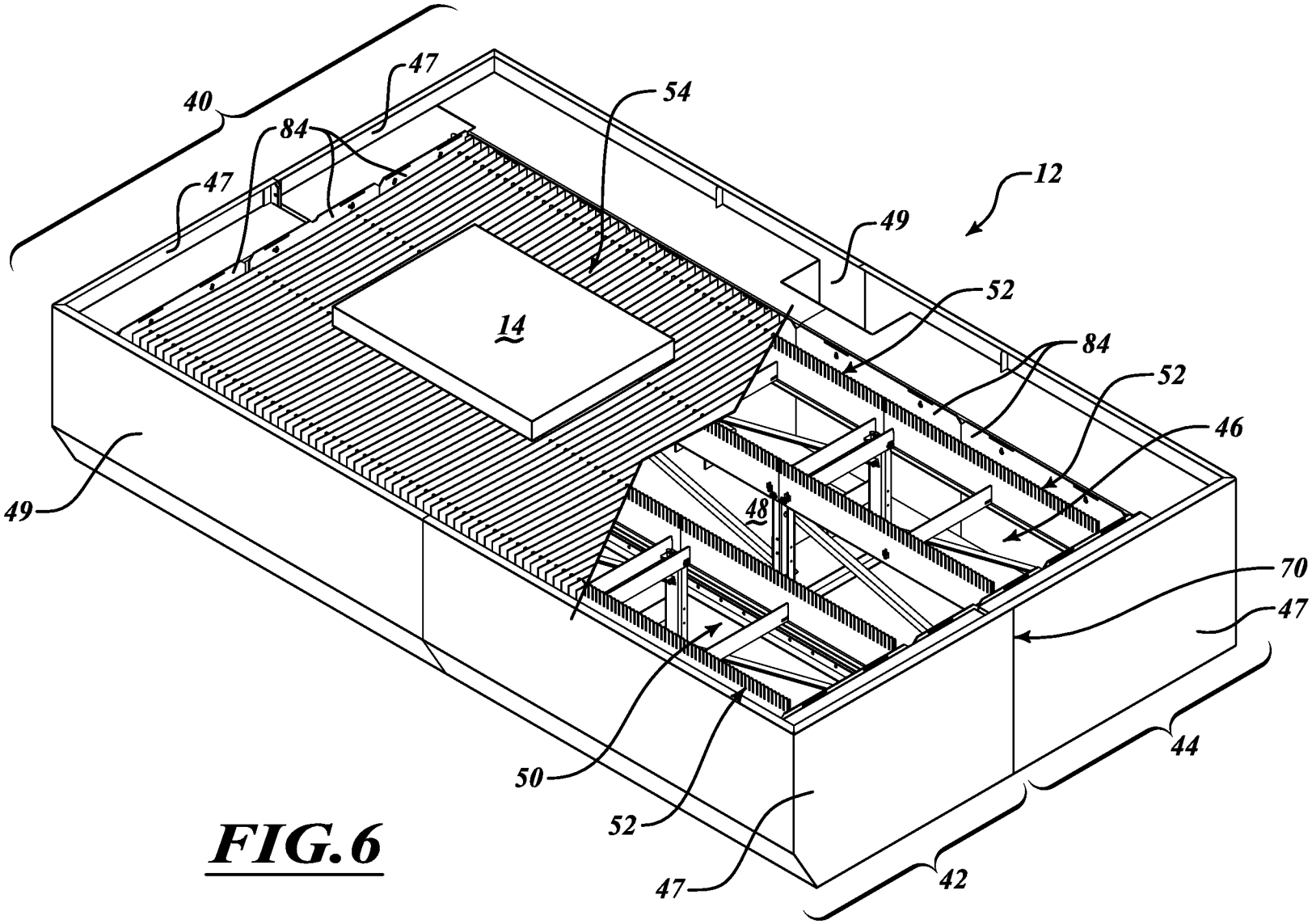
FIG. 6 is an isometric view of the catcher tank assembly of FIG. 5 in an assembled configuration with the workpiece platform added but partially removed to reveal the workpiece support modules.

FIG. 6 shows the catcher tank assembly 12 in an assembled configuration with the platform 54 received in and supported by the array of workpiece support modules 52 of the workpiece support system 50. A workpiece 14 is shown on the platform 54 ready for processing. As can be appreciated from FIG. 6, in a final assembled configuration, the catcher tank assembly 12 may include the optional armor plates 84 secured around the perimeter of the internal tank cavity 46 which is defined by the joined tank sections 42, 44. The armor plates 84 may be removably secured to the tank sections 42, 44 by fasteners or by hanging the armor plates 84 from protrusions formed in the tank sections 42, 44, for example. In other embodiments, armor plates 84 may be integrally formed in the tank sections 42, 44; however, removably securing the armor plates 84 enables more versatility and allows the armor plates 84 to be selectively replaced or serviced. Additional armor plates or structures (not shown) may also be provided within the tank cavity 46 to protect the floor 48 of the tank sections 42, 44 or other internal structures during operation.

FIG. 7 further illustrates the versatility of the catcher tank assemblies 12, 12' and subcomponents described herein. The catcher tank assembly 12' shown in FIG. 7, for example, includes an intermediate tank section or unit 43 disposed between the tank sections or tank end units 42, 44 of the previously described catcher tank 40 to form a catcher tank 40' characterized by a much larger tank capacity. Although only one intermediate tank section or unit 43 is shown, two, three, four or more intermediate tank sections or units 43 may be provided to selectively construct catcher tanks 40' of increasing capacity. Each mating interface 70 between the tank sections 42, 43, 44 is provided with a seal arrangement to provide a water-tight catcher tank 40'.

The intermediate tank sections or units 43 may be configured to accept additional rows of workpiece support modules 52, such that, when the catcher tank assembly 12' is fully assembled, the workpiece support modules 52 are arranged in a two-dimensional array having a plurality of rows and a plurality of columns to collectively support the workpiece platform 54' within the confines of the catcher tank 40'. For example, the catcher tank assembly 12' may include a 4×3 array of workpiece support modules 52 as illustrated in FIG. 7. In other embodiments, the array of workpiece support modules 52 may be arranged, for example, in a 2×2, 2×3, 2×4, 2×5, 2×6, 3×2, 3×3, 3×4, 3×5, 3×6, 4×2, 4×4, 4×5, 4×6, 5×2, 5×3, 5×4, 5×5, 5×6 array or in arrays with more or fewer rows and columns. Still further, tank sections or units 42, 43, 44 may be provided in different widths to provide flexibility in tank width as well as depth. In this manner, catcher tank assemblies 12, 12' having an extremely wide variance of capacities may be constructed from a particularly limited set of modular tank sections 42, 43, 44 and modular components of the workpiece support system 50.

In some embodiments, each of the tank sections or units 42, 43, 44 may be sized to fit within the confines of a standard 40 ft shipping container such that the tank sections or units 42, 43, 44 may be conveniently shipped to remote locations in shipping containers and assembled on site to construct a catcher tank assembly 12, 12' having a footprint far in excess of the footprint of the shipping container itself (e.g. two to three times larger).

Figure 8:
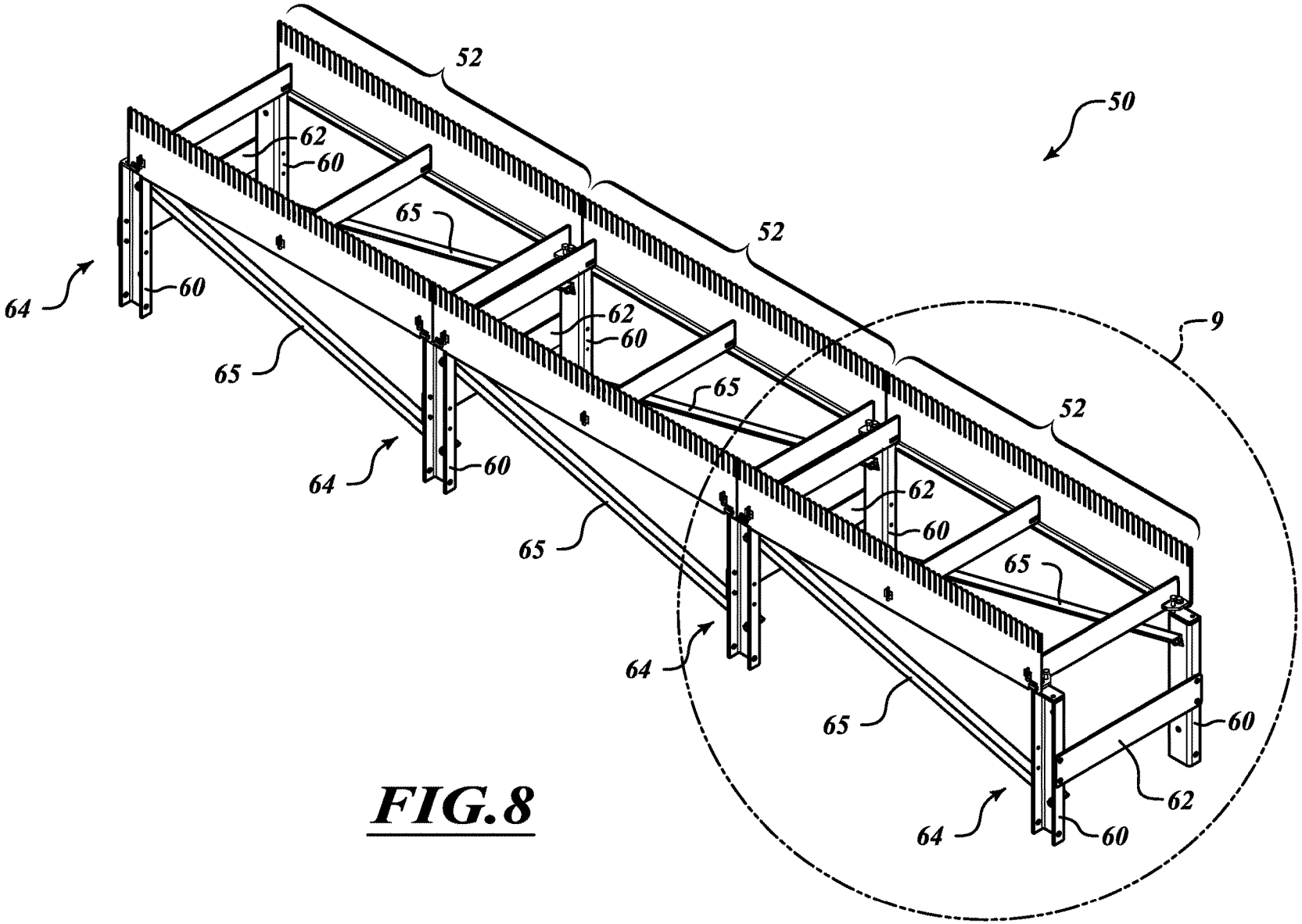
FIG. 8 is an isometric view of workpiece support modules of the catcher tank assembly of the waterjet cutting system of FIG. 1.

Further details of the workpiece support system 50 are described with reference to FIGS. 8 through 10. As shown in FIG. 8, a series of workpiece support modules 52 may be arranged in a linear pattern to form an interconnected row. Each of the workpiece support modules 52 can be supported at opposing ends thereof by the upstanding support structure 64, such as, for example, the H-shape support structure described earlier which includes a set of upstanding support columns 60 and cross member 62. Adjacent sets of the support structures 64 may likewise be connected by one or more cross members 65.

The entirety of the workpiece support system 50 can be removably coupled to the interior of the catcher tank assemblies 12, 12' described herein, and more particularly, without any connection to sidewalls 47 or end walls 49 of the same. In this manner, the workpiece support system 50 can be a freestanding, self-supporting comprehensive workpiece platform support structure separate from the catcher tanks 40, 40' altogether. The workpiece support system 50 may be bolted or otherwise removably secured to the floor 48 of the catcher tanks 40, 40', and more particularly, a row or more of the workpiece support system 50 may be bolted or otherwise removably secured to the floor 48 within a respective tank section or unit 42, 43, 44. Of course, in some embodiments, the workpiece support system 50 could be fixedly secured to the floor 48 of the catcher tanks 40, 40', for example, by welding the support structures 64 thereto; however, fixedly joining components of the workpiece support system 50 reduces the versatility of the system 50 to adapt to changing conditions and diminishes the ability of the catcher tank assemblies 12, 12' to accommodate a wide variety of processing activities.

Figure 9:
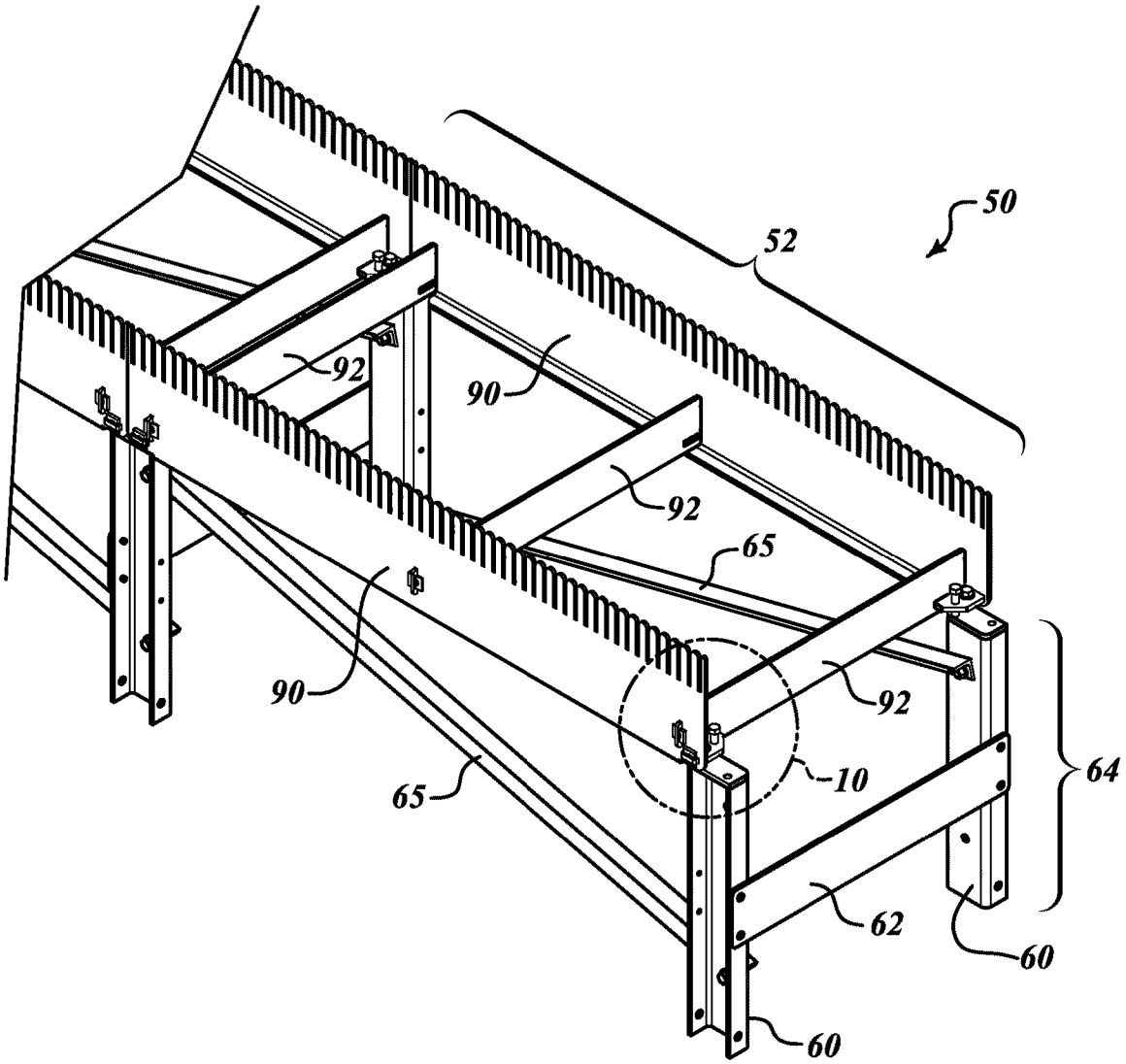
FIG. 9 is an isometric partial detail view of the portion of the workpiece support modules of FIG. 8.

With reference to FIG. 9, the workpiece support modules 52 of the workpiece support system 50 may be formed as a generally rectangular module having opposing longitudinal platform support members 90 separated from each other by transverse cross members 92. The workpiece support modules 52 may resemble a lattice or ladder structure. A tab portion 94 of the transverse cross members 92 may extend through the longitudinal platform support members 90 and be secured thereto by driving wedge-shaped fasteners 96 through an aperture in the tab portion 94, as shown best in FIG. 10. In this manner, the lattice or ladder-like structure of the workpiece support modules 52 may be assembled and disassembled in a particularly efficient manner. Of course, it is appreciated that in other embodiments conventional fastening devices, such as, for example, threaded bolts, may be used to join components of the workpiece support modules 52. Still further, in other embodiments, the workpiece support modules 52 may be unitary structures, such as, for example, a unitary structure having components joined together by welding or a unitary casting.

Figure 10:
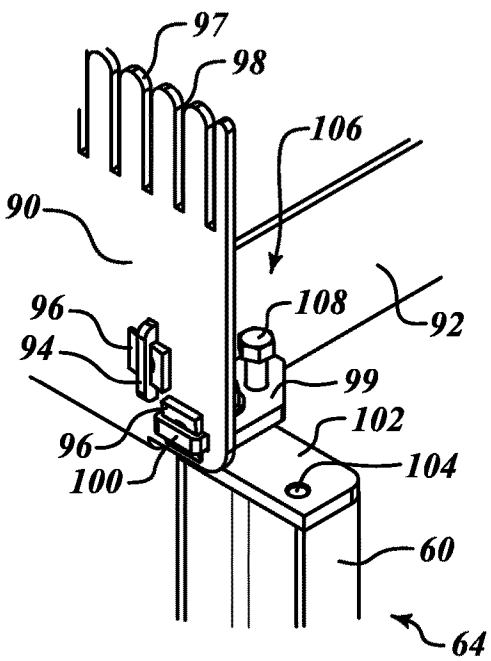
FIG. 10 is an isometric enlarged detail view of the portion of the workpiece support modules of FIG. 8.

As best shown in FIG. 10, the longitudinal platform support members of the workpiece support modules 52 may include a series of upstanding fingers 97 and corresponding slots 98 to selectively receive slats 56 (FIG. 3) to collectively define the platform 54 (FIG. 3). In other embodiments, the workpiece support modules 52 may include other mounting arrangements to selectively receive mesh plates, grates or other structures to form the workpiece platform 54 (FIG. 3). The workpiece support modules 52 may further include feet 99 for mounting the workpiece support modules 52 to the upstanding support structures 64. The feet 99 may be secured to the workpiece support modules 52 in a removable manner similar to that discussed above with respect to the cross members 92. For example, a tab portion 100 of each foot may extend through another component of the module 52 and receive a wedge-shaped fastener 96 through an aperture in the tab portion 100. Again, it is appreciated that in other embodiments conventional fastening devices, such as, for example, threaded bolts, may be used to join components of the workpiece support modules 52. In addition, in some embodiments, the feet 99 may be formed integrally in the longitudinal platform support members 90 or cross members 92.

Each foot 99 is positioned to align with an upper end of a respective support column 60 of the workpiece support structure 64 when the workpiece support system 50 is assembled. Each support column 60 of the support structures 64 may include a mount plate 102, flange or other structure with mounting apertures 104 therein for receiving fasteners to attach a respective foot 99 thereto. While the workpiece support modules 52 may be bolted or otherwise joined flush to an upper end of the support structures 64, in some embodiments, height adjustment devices 106 may be provided intermediate the workpiece support modules 52 and the support structures 64 to enable leveling adjustments of the workpiece support modules 52. For instance, a threaded adjustment bolt 108 or other adjustable stop may be provided on each foot 99 to selectively set a height of a gap between the foot 99 and the respective support structure 64 to which it is joined during assembly. Adjustments may be made to the gap by turning the adjustment bolt 108 prior to securing the foot 99 to the support structure 64 by tightening other threaded fasteners received in the mounting apertures 104 in the mount plate 102, for example. By selectively adjusting each gap, the upper work surface 58 (FIG. 3) of the workpiece platform 54 (FIG. 3) may be leveled to a relatively high degree of precision.

Figure 11:
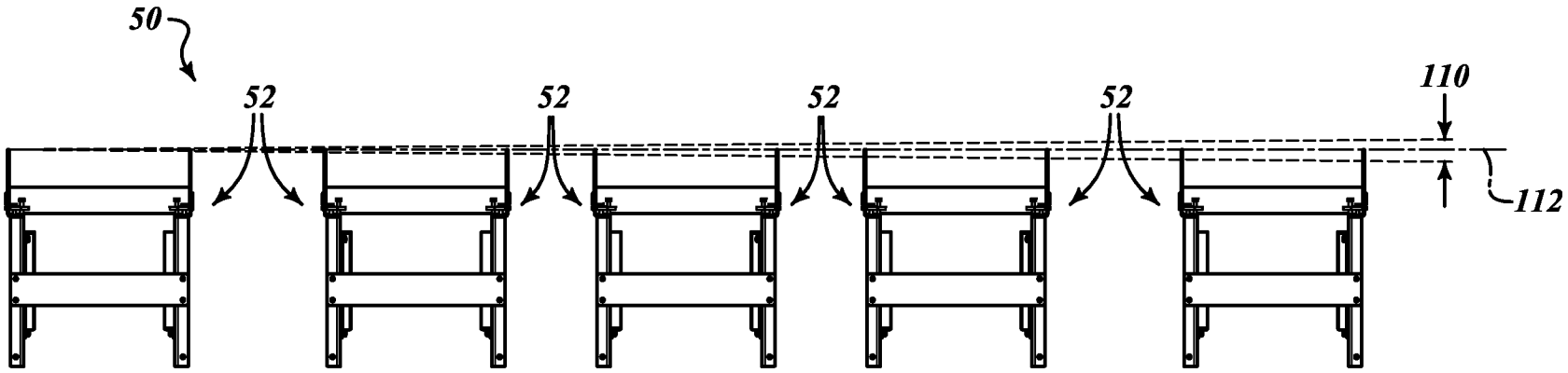
FIG. 11 is a side elevational view of a series of workpiece support modules, according to one embodiment, illustrating leveling capabilities thereof.
Figure 12:
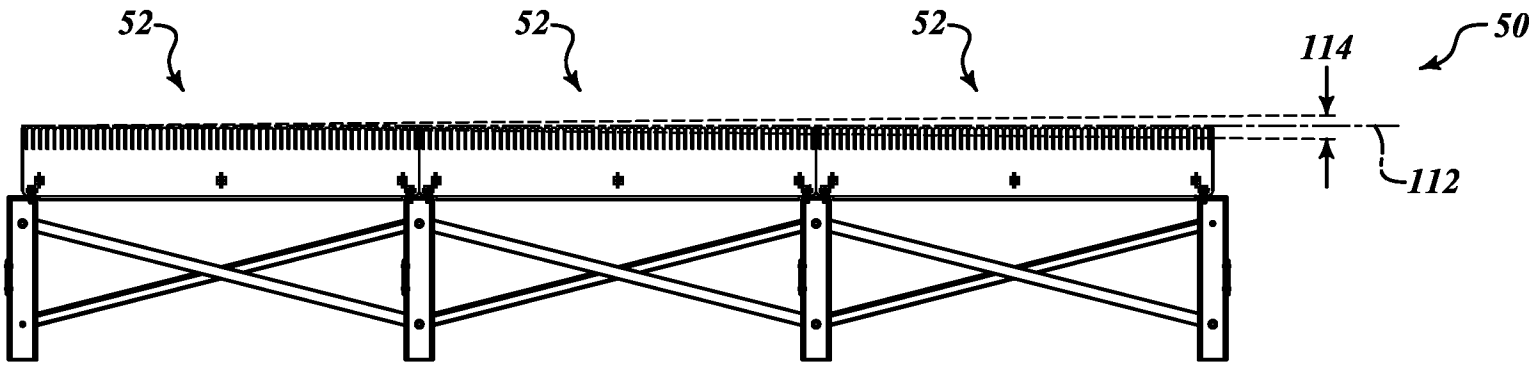
FIG. 12 is a front elevational view of the workpiece support modules of FIG. 11 illustrating additional leveling capabilities thereof.

The overall adjustability of the workpiece support system 50, according to one embodiment, is illustrated in FIGS. 11 and 12. More particularly, FIG. 11 illustrates the leveling capabilities over a depth of a catcher tank assembly which includes five rows of workpiece support modules 52. In some embodiments, the degree of adjustability 110 may be ±1, 2 or 3 degrees from a horizontal reference plane 112 or more or less. FIG. 12 illustrates the leveling capabilities over a width of a catcher tank assembly which includes three workpiece support modules 52 arranged in a row. In some embodiments, the degree of adjustability 114 may be ±1, 2 or 3 degrees from the horizontal reference plane 112 or more or less.

Figure 13:
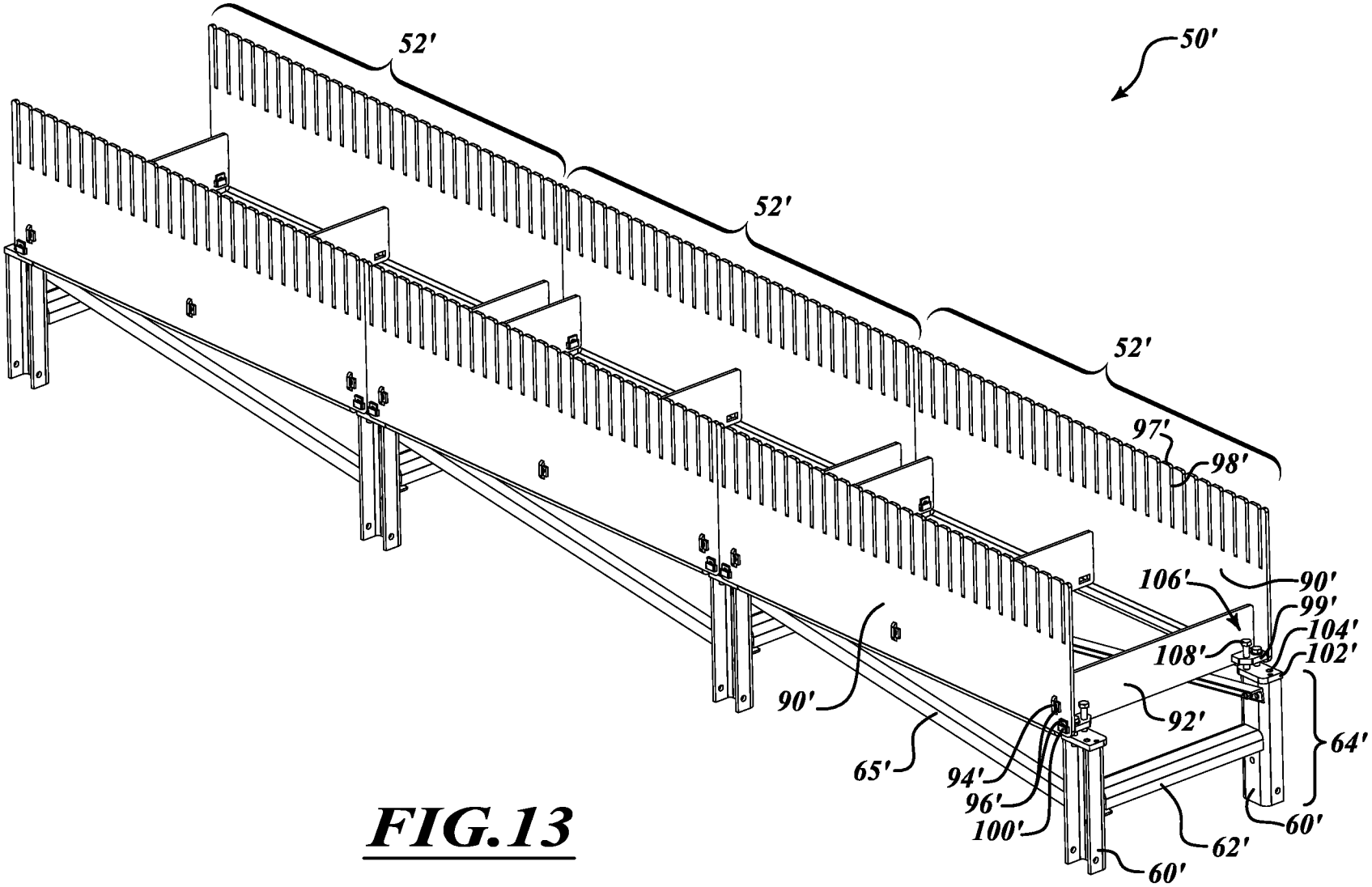
FIG. 13 is an isometric view of workpiece support modules, according to another embodiment.
Figure 14:
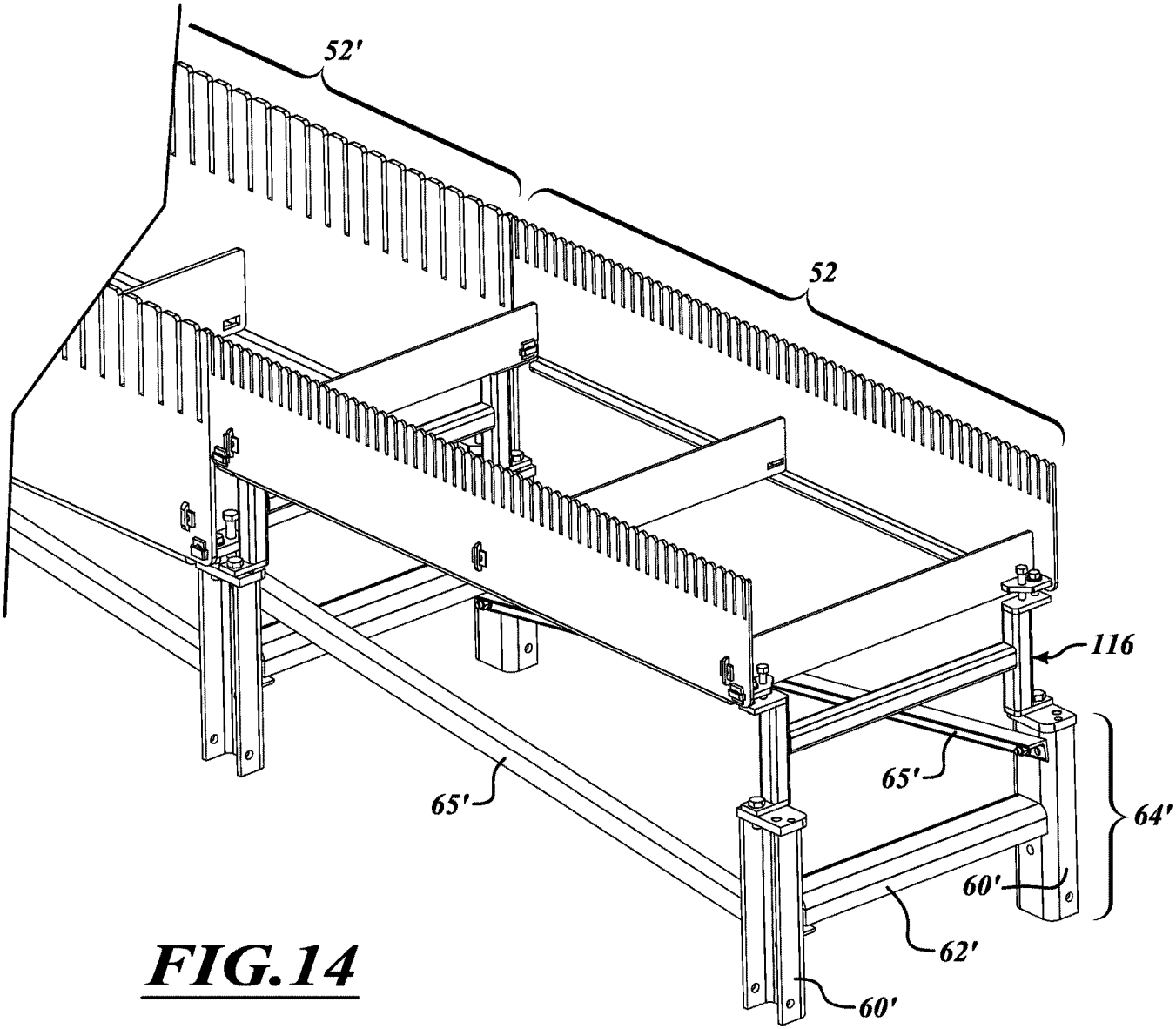
FIG. 14 is a partial isometric view of workpiece support modules, according to yet another embodiment.

FIGS. 13 and 14 still further illustrate the versatility of embodiments of the catcher tank assemblies 12, 12' described herein. For instance, FIG. 13 shows another embodiment of a workpiece support system 50' which is configured to support relatively more weight than the system 50 illustrated in FIG. 8. The overall system 50' shares similar features and qualities to the previously described system 50; however, certain components may be of different shapes, sizes, and strengths. For instance, the workpiece support system 50' is similar in that it includes a plurality of workpiece support modules 52' formed as a generally rectangular module having opposing longitudinal platform support members 90' separated by transverse cross members 92'. A tab portion 94' of the transverse cross members 92' also extends through the longitudinal platform support members 90' and can be secured thereto by driving wedge-shaped fasteners 96' through an aperture in the tab portion 94'. In this manner, the lattice or ladder-like structure of the workpiece support modules 52' may be assembled and disassembled in a particularly efficient manner. Again, it is appreciated that in other embodiments conventional fastening devices, such as, for example, threaded bolts, may be used to join components of the workpiece support modules 52'. Still further, in other embodiments, the workpiece support modules 52' may be unitary structures, such as, for example, a unitary structure having components joined together by welding or a unitary casting.

The longitudinal platform support members 90' of the workpiece support modules 52' may include a series of upstanding fingers 97' and corresponding slots 98' to selectively receive slats 56 (FIG. 3) to collectively define the platform 54 (FIG. 3). The slots 98', however, may be relatively thicker and/or longer to receive slats 56 that are able to support a more substantial static load. Again, in other embodiments, the workpiece support modules 52' may include other mounting arrangements to selectively receive mesh plates, grates or other structures to form the workpiece platform 54.

Like the previously described workpiece support modules 52, the workpiece support modules 52' of the relatively higher capacity workpiece support system 50' may further include feet 99' for mounting the workpiece support modules 52' to upstanding support structures 64'. The feet 99' may be secured to the workpiece support modules 52' in a removable manner similar to that discussed above. For example, a tab portion 100' of each foot may extend through another component of the workpiece support modules 52' and receive the wedge-shaped fastener 96' through an aperture in the tab portion 100'. Again, it is appreciated that in other embodiments conventional fastening devices, such as, for example, threaded bolts, may be used to join components of the workpiece support modules 52'. In addition, in some embodiments, the feet 99' may be formed integrally in the longitudinal platform support members 90' or cross members 92'.

Each foot 99' is positioned to align with an upper end of a respective support column 60' of the workpiece support structure 64' when the workpiece support system 50' is assembled. Each support column 60' of the support structures 64' may include a mount plate 102', flange or other structure with mounting apertures 104' therein for receiving fasteners to attach a respective foot 99' thereto. While the workpiece support modules 52' may be bolted or otherwise joined flush to an upper end of the support structures 64', in some embodiments, height adjustment devices 106' may be provided intermediate the workpiece support modules 52' and the support structures 64' to enable leveling adjustments of the workpiece support modules 52'. For instance, a threaded adjustment bolt 108' or other adjustable stop may be provided on each foot 99' to selectively set a height of a gap between the foot 99' and the respective support structure 64' to which it is joined during assembly.

Some differences between the workpiece support modules 52' of the relatively higher capacity workpiece support system 50' include relatively taller longitudinal platform support members 90'. In addition, the thickness and/or grade of the components may be such that the workpiece support modules may support a considerably larger static load (e.g., two or more times the load) without experiencing permanent deformation. For example, in one embodiment, the relatively lower capacity workpiece support system 50 may be configured to support a static load of about 1500 kg/m$^2$ without permanent deformation and within a generally accepted safety margin. In contrast, in one embodiment, the relatively higher capacity workpiece support system 50' is configured to support a static load of about 3000 kg/m$^2$ without permanent deformation and within a generally accepted safety margin. In some embodiments, the workpiece support system 50' may be configured to support a static load of about 4000 kg/m$^2$ without permanent deformation and within a generally accepted safety margin. The support columns 60' of the relatively higher capacity workpiece support system 50' may also be relatively shorter and less susceptible to buckling under extreme loading conditions. Still further, the cross members 92' of the relatively higher capacity workpiece support system 50' may be significantly more rigid than cross members 92 of the relatively lower capacity workpiece support system 50. For example, the cross members 92' of the relatively higher capacity workpiece support system 50' may be stock channel structures as opposed to flat plate structures.

Despite the aforementioned differences and other differences, the relatively higher capacity workpiece support system 50' is nevertheless configured to interface with the catcher tank assemblies 12, 12' within the same footprint area as the relatively lower capacity workpiece support system 50. In some embodiments, the relatively higher capacity workpiece support system 50' may attach to the catcher tank assemblies 12, 12' in the same manner as the relatively lower capacity workpiece support system 50. Accordingly, the catcher tank assemblies 12, 12' may be selectively fitted with a relatively higher capacity workpiece support system 50' or a relatively lower capacity workpiece support system 50 or combinations of the same. For example, some catcher tank assemblies 12, 12' may be provided with one or more rows of the relatively higher capacity workpiece support system 50' and one or more rows of the relatively lower capacity workpiece support system 50. Still further, as illustrated in FIG. 14, components from each of the different workpiece support systems 50, 50' may be combined to form hybrid rows in which different capacity workpiece support modules 52, 52' are provided within the same row. In such embodiments, a spacer or extension 116 may be provided to adapt the relatively lower capacity workpiece support module 52 to interface with the underlying support structure 64' of the relatively higher capacity workpiece support system 50'. Accordingly, a workpiece platform 54 (FIG. 3) may ultimately be supported in an assembled configuration by an array of workpiece support modules 52, 52' of varying capacities. In addition, in some embodiments, the specialized workpiece fixtures 88 may replace one or more of the workpiece support modules 52, 52', as illustrated in FIG. 7. Additionally, in some embodiments, areas within the catcher tank 40, 40' may be provided without any support structures.

Figure 15:
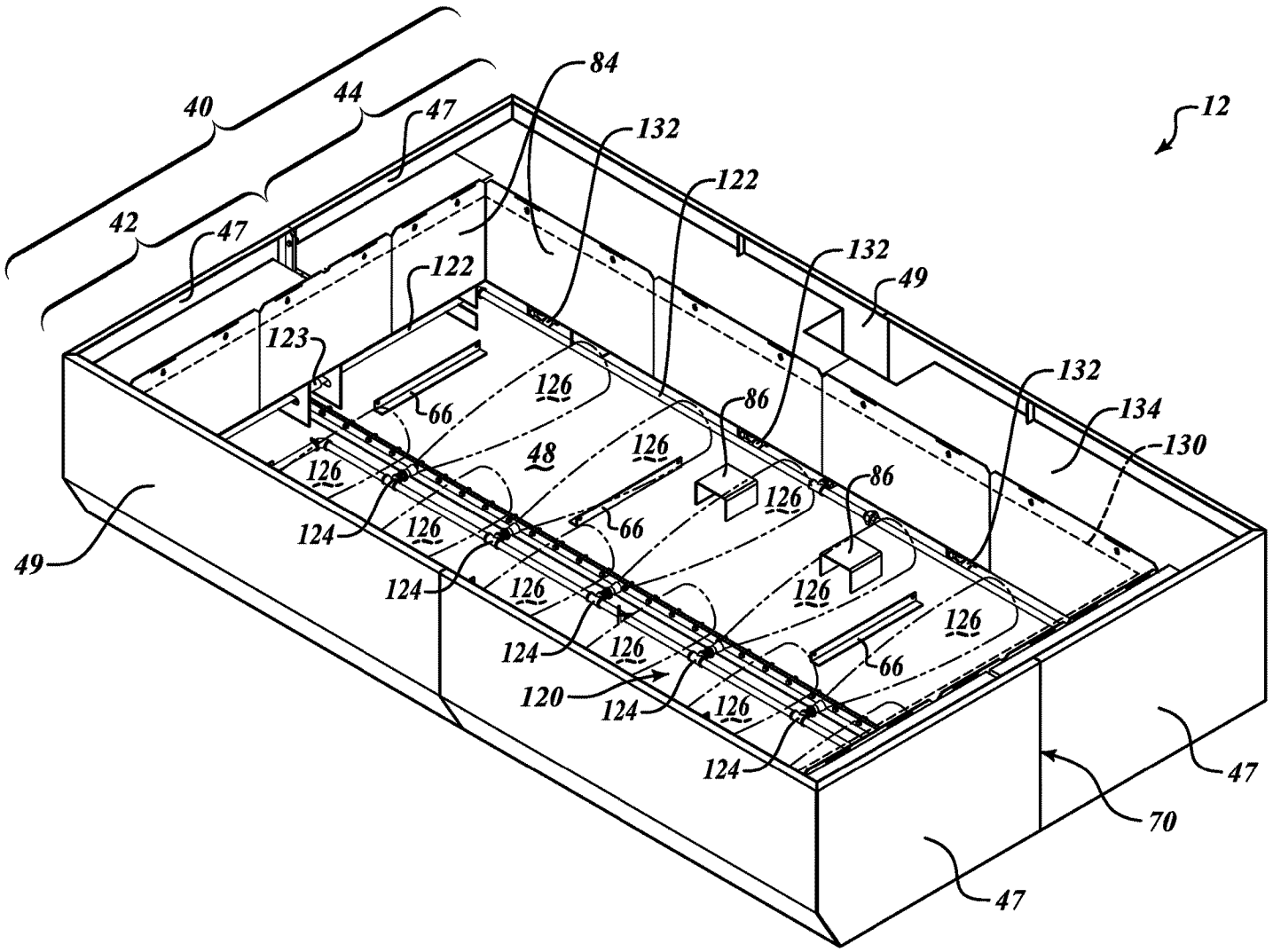
FIG. 15 is an isometric view of the catcher tank assembly of the waterjet cutting system of FIG. 1 with the workpiece platform and workpiece support system removed to reveal a waste removal system of the catcher tank assembly, according to one embodiment.
Figure 16:
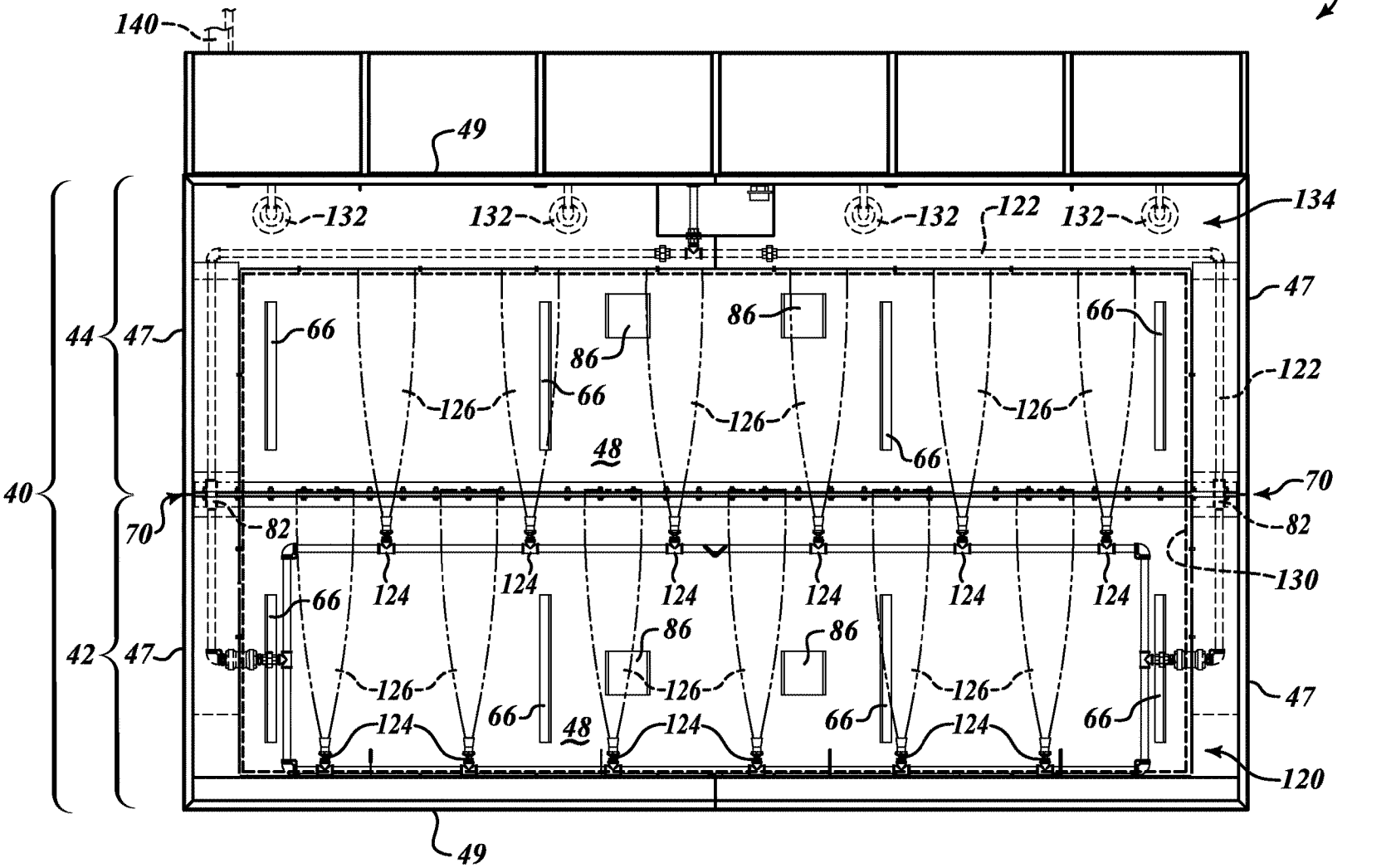
FIG. 16 is a top plan view of the catcher tank assembly shown in FIG. 15.

FIGS. 15 and 16 show the catcher tank assembly 12 without the workpiece support system 50 coupled thereto to reveal a portion 120 of the waste removal system 30 (FIG. 1) which may be positioned within a lower region of the catcher tank 40. The portion 120 of the waste removal system 30 within the catcher tank 40 may include the conduit system 122 coupled to a plurality of nozzles 124 which are configured to produce flushing jet streams 126 within each tank section or unit 42, 44 of the catcher tank 40. The flushing jet streams 126 are arranged to effectively cover at least a majority of the footprint of an operative working area 130 of the catcher tank assembly 12. The flushing jet streams 126 interoperate to flush waste or debris, such as, for example, spent abrasives, within the catcher tank 40 toward a plurality of waste pickups 132. The pickups 132 may be located beneath covers 134 in an end region of the catcher tank 40 outside of the foot print of the operative working area 130. In this manner, the pickups 132 are substantially protected from deteriorative influences of the cutting jet during operation. Likewise, as best shown in FIG. 16, a substantial portion of the conduit system 122 may be located under covers in peripheral regions of the catcher tank 40 outside of the operative working area 130. This portion of the conduit system 122 is likewise substantially protected from deteriorative influences of the cutting jet during operation.

The conduit system 122 may include valves and controls to selectively route a flushing fluid to selected areas of the catcher tank 40 independently of each other. For example, nozzles 124 located on one stretch of the conduit system 122 may be activated independently of nozzles 124 located on another stretch of the conduit system 122. This is particularly beneficial in larger catcher tank assemblies having three or more tank sections or units 42, 43, 44 wherein it may be quite inefficient to operate nozzles 124 remote from a processing location. For example, the cutting head 22 (FIGS. 1 and 2) may be processing a workpiece within one area overlying one particular tank section 42, 43, 44 for an extended period of time such that spent abrasives or other debris generated during the cutting process is not generated within other tank sections 42, 43, 44. During such periods, portions of the conduit system 122 corresponding to the inactive areas may be temporarily restrained from passing fluid through the nozzles 124 to, among other things, conserve energy. The activation of regions of the waste removal system 30 may be controlled automatically in tandem with movements of the cutting head 22 via the control system 28 (FIGS. 1 and 2). Waste and wastewater collected via the pickups 132 can be routed external to the catcher tank assembly 12 via a discharge conduit 140 for subsequent processing and optional reintroduction of recycled fluid back into the catcher tank 40 and/or reintroduction of recycled abrasives back into the waterjet cutting system 10.

The various features and aspects described herein provide for catcher tank assemblies 12, 12' having particularly versatile form factors to address a wide variety of demands and changing conditions. For instance the interconnectivity of the modular tank sections 42, 43, 44 can enable a user to construct catcher tanks 40, 40' of varying sizes and capabilities to meet the specific demands of specialized work cells in a production line.

As an example, a relatively small catcher tank 40 may be constructed of two end units 42, 44 in an abutting relationship and located in a production line dedicated to certain activities requiring no more work area than that provided by the relatively smaller catcher tank 40. Further, the catcher tank 40 in this cell may be dedicated to cutting relatively softer materials that do not require cutting with abrasives, but rather which may be processed with a pure water jet. In this scenario, the user may opt not to install a waste removal system 30. Further, it may not be advantageous based on the expected processing demands within this cell to install a water level control system 69 (FIG. 3).

In contrast, a relatively larger catcher tank 40' having three, four, five or more tank sections 42, 43, 44 may be located in the same production line wherein a larger work area is required to process workpieces. This relatively larger catcher tank 40' may be dedicated, for example, to processing larger, heavy slab materials. These types of materials may require the use of abrasive waterjets for efficient processing and benefit from the use of water level control systems 69. Thus, the catcher tank 40' may be provided with a waste removal system 30 installed therein and a water level control system 69 integrated into one of the tank sections 44 within a dedicated region 68 (FIG. 3) for optional accessories. In addition, workpiece support systems 50' having a relatively higher load capacity may be required to safely process the heavier workpieces. Despite the different processing requirements, the catcher tank assemblies 12, 12' can be constructed with many of the same components and can be readily reconfigured from one catcher tank configuration to another.

Furthermore, the catcher tank assemblies 12, 12' described herein can be readily dissembled for transport or relocation within an assembly line, for example. Smaller catcher tank assemblies 12 may be easily converted into larger catcher tank assemblies 12', and vice versa. Smaller capacity workpiece support systems 50 may be easily converted into larger capacity workpiece support systems 50', and vice versa. Catcher tank assemblies 12, 12' can be easily upgraded with new or different capabilities (e.g., water leveling, waste removal). These and other benefits are realized as a result of the various aspects of the catcher tank assemblies 12, 12' disclosed herein.

Although the shapes and features of the tank sections 42, 43, 44 and workpiece support systems 50, 50' are illustrated in particularly versatile and compact form factors, it is appreciated that the shapes and sizes of various features of the components can vary significantly while still providing the functionality described herein. For instance, although the tank sections 42, 43, 44 are shown as including vertical opposing sidewalls 47 and end walls 49, the sidewalls 47 and end walls 49 may, for example, flare outwardly to form a tank cross-section having a flat bottomed V-shape. In addition, although many of the components of the workpiece support systems 50, 50' are illustrated as conventional stock materials (e.g., angle iron, u-channels and plates), it is appreciated that these components may take a variety of forms including, for example, castings with complex curved surfaces. Still further, although it is contemplated that many of the structural components of the catcher tank sections 42, 43, 44 and workpiece support systems 50, 50' can be formed of mild or high strength steel, other materials of appropriate strength and durability may be used. Accordingly, one skilled in the relevant art will recognize that embodiments may be practiced without one or more of the specific details shown and described herein.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A catcher tank assembly for a waterj et cutting machine, the catcher tank assembly comprising:

a catcher tank including a plurality of tank sections, each tank section comprising opposing sidewalls and a floor extending therebetween that define one of opposing sides of a u-shaped mating interface that extends a full width of the catcher tank between adjacent tank sections, each u-shaped mating interface being provided with a respective sealing device in sealing contact with the adjacent tank sections, a number of the u-shaped mating interfaces of the catcher tank and a number of the sealing devices each being exactly one less than the number of tank sections, and the tank sections being detachably coupled together in a side-by-side manner to collectively define an internal tank cavity to hold a volume of water for absorbing energy of a jet generated by the waterjet cutting machine during a cutting operation, and the floors of the tank sections collectively defining a tank floor, wherein each of the floors includes an inner surface that faces the internal tank cavity and the respective sealing device is positioned within the internal tank cavity such that the respective sealing device contacts the inner surfaces of the floors of both adjacent tank sections;

a workpiece platform that forms an upper work surface of the catcher tank upon which to support a workpiece to be processed during the cutting operation; and a workpiece support system detachably coupled to the tank floor, the workpiece support system including a plurality of workpiece support modules that are arranged in an array beneath the workpiece platform and that cooperatively support the workpiece platform.

2. The catcher tank assembly of claim 1 wherein the catcher tank is configured such that a first row of the array of workpiece support modules is detachably coupled to a first one of the tank sections and a second row of the array of workpiece support modules is detachably coupled to a second one of the tank sections, and wherein the first row and the second row of the array of workpiece support modules cooperatively support the workpiece platform.

3. The catcher tank assembly of claim 1 wherein the plurality of tank sections of the catcher tank include two tank end units and an intermediate tank unit, the plurality of tank sections being reconfigurable between a first tank configuration, in which the end tank units are detachably coupled together, and a second tank configuration, in which the end tank units are detachably coupled to opposing sides of the intermediate tank unit to provide an internal tank cavity larger than an internal tank cavity of the first tank configuration.

4. The catcher tank assembly of claim 1 wherein each of the plurality of tank sections of the catcher tank further includes a flange extending across one of the opposing sidewalls along the floor and across the other one of the opposing sidewalls to define the u-shaped mating interface that selectively assembles the tank sections in the side-by-side manner collectively defining the internal tank cavity.

5. The catcher tank assembly of claim 1 wherein each of the tank sections of the catcher tank includes an upstanding flange offset from an abutment edge, and wherein the sealing device of each u-shaped mating interface of the catcher tank is a cord compressibly disposed between the upstanding flanges of two adjacent tank sections.

6. The catcher tank assembly of claim 5 wherein the catcher tank further includes at least one spacer disposed between the upstanding flanges of the two adjacent tank sections to control a degree of compression of the cord.

7. The catcher tank assembly of claim 6 wherein the abutment edges, the upstanding flanges, and the at least one spacer combine to define a box-like cavity that captively receives the cord.

8. The catcher tank assembly of claim 1 wherein the workpiece support system further includes a plurality of adjustment devices for selectively leveling the workpiece support modules to level the workpiece platform supported thereon.

9. The catcher tank assembly of claim 1 wherein the workpiece support system further includes a plurality of elongated support columns, and wherein the workpiece support system is detachably coupled to the tank floor by the plurality of elongated support columns to support the workpiece support modules at a height above the tank floor, adjacent sets of the elongated support columns supporting opposing ends of a respective workpiece support module.

10. The catcher tank assembly of claim 9 wherein at least one set of the elongated support columns supports an end of each of two adjacent workpiece support modules.

11. The catcher tank assembly of claim 9 wherein the workpiece support system further includes a plurality of adjustment devices, at least one adjustment device provided for each set of the elongated support columns at each of opposing ends of the workpiece support modules.

12. The catcher tank assembly of claim 9 wherein a load capacity of the elongated support columns supporting a first one of the workpiece support modules is at least twice the load capacity of the elongated support columns supporting a second one of the workpiece support modules.

13. The catcher tank assembly of claim 1, further comprising:

a waste removal system, the waste removal system configured to span an interface between adjacent tank sections to transport a flushing fluid from a first one of the tank sections to at least a second one of the tank sections.

14. The catcher tank assembly of claim 13 wherein the waste removal system includes a plurality of nozzles configured to generate flushing jets directed into areas of each of the plurality of tank sections.

15. The catcher tank assembly of claim 14 wherein a first set of the nozzles in one region of the catcher tank is selectively operable independent of a second set of the nozzles in another region of the catcher tank.

16. The catcher tank assembly of claim 1, further comprising:

a water level control system at least partially integrated into one of the tank sections, the water level control system configured to selectively control a height of the volume of water in the catcher tank during the cutting operation.

17. The waterjet cutting system of claim 1 wherein the catcher tank includes a plurality of armor plates detachably coupled to interior sidewalls of the catcher tank.

18. The catcher tank assembly of claim 1 wherein each of the workpiece support modules includes a plurality of elongated, vertically arranged slots that receive a plurality of slats, the slats received in the slots collectively define the workpiece platform.

19. A waterjet cutting system, comprising:

a cutting head movably coupled to a multi-axis machine and operable to process a workpiece via a cutting operation;

a catcher tank configured to hold a volume of water for absorbing the energy of a jet generated by the cutting head of the waterj et cutting system during the cutting operation, the catcher tank including a plurality of tank sections, each tank section comprising opposing sidewalls and a floor extending therebetween that define one of opposing sides of a u-shaped mating interface that extends a full width of the catcher tank between adjacent tank sections, each u-shaped mating interface being provided with a respective sealing device in sealing contact with the adjacent tank sections, a number of the u-shaped mating interfaces of the catcher tank and a number of the sealing devices each being exactly one less than the number of tank sections, and the tank sections being detachably coupled together in a side-by-side manner to collectively define an internal tank cavity, and the floors of the tank sections collectively defining a tank floor, wherein each of the floors of the tank sections includes an inner surface that faces the internal tank cavity and the respective sealing device is positioned within the internal tank cavity such that the respective sealing device contacts the inner surfaces of the floors of both adjacent tank sections;

a workpiece platform that forms an upper work surface of the catcher tank upon which to support the workpiece to be processed during the cutting operation; and a workpiece support system detachably coupled to the tank floor, the workpiece support system including a plurality of workpiece support modules that are arranged in an array beneath the workpiece platform and that cooperatively support the workpiece platform.

20. The waterjet cutting system of claim 19 wherein a first row of the array of workpiece support modules is detachably coupled to a first one of the tank sections and a second row of the array of workpiece support modules is detachably coupled to a second one of the tank sections.

21. The waterjet cutting system of claim 19 wherein the plurality of tank sections of the catcher tank include two tank end units and an intermediate tank unit, the end tank units detachably coupled to opposing sides of the intermediate tank unit to collectively define the internal tank cavity.

22. The waterjet cutting system of claim 19 wherein each of the plurality of tank sections of the catcher tank further includes a flange extending across one of the opposing sidewalls along the floor and across the other one of the opposing sidewalls to define the u-shaped mating interface.

23. The waterjet cutting system of claim 19 wherein each of the tank sections of the catcher tank includes an upstanding flange, and wherein the sealing device of each u-shaped mating interface of the catcher tank is a cord compressibly disposed between the upstanding flanges of two adjacent tank sections.

24. The waterjet cutting system of claim 23 wherein the two adjacent tank sections are detachably coupled together with a spacer disposed therebetween collectively defining a box-like cavity that captively receives the cord.

25. The waterjet cutting system of claim 20 wherein the workpiece support system further includes a plurality of adjustment devices for selectively leveling the workpiece support modules to level the workpiece platform supported thereon.

26. The waterjet cutting system of claim 19 wherein the workpiece support system further includes a plurality of elongated support columns, and wherein the workpiece support system is detachably coupled to the tank floor by the plurality of elongated support columns to support the workpiece support modules at a height above the floor, adjacent sets of the elongated support columns supporting opposing ends of a respective one of the workpiece support modules.

27. The waterjet cutting system of claim 19, further comprising:

a waste removal system, the waste removal system spanning an interface between adjacent tank sections to transport a flushing fluid from a first one of the tank sections to at least a second one of the tank sections.

28. The waterjet cutting system of claim 27 wherein the waste removal system includes a plurality of nozzles configured to generate flushing jets directed into areas of each of the plurality of tank sections.

29. The waterjet cutting system of claim 28 wherein a first set of the nozzles in one region of the catcher tank is selectively operable independent of a second set of the nozzles in another region of the catcher tank.

30. The waterjet cutting system of claim 19, further comprising:

a water level control system at least partially integrated into one of the tank sections to selectively control a height of the volume of water in the catcher tank during the cutting operation.

31. The waterjet cutting system of claim 19 wherein the plurality of workpiece support modules arranged in the array support a plurality of slats such that the slats collectively define the workpiece platform.

32. The waterjet cutting system of claim 19 wherein the catcher tank includes a plurality of armor plates detachably coupled to interior sidewalls of the catcher tank.

33. The waterjet cutting system of claim 19 wherein a fixture device for a workpiece is secured to the catcher tank among the array of workpiece support modules.

34. The waterjet cutting system of claim 19 wherein the catcher tank includes at least one intermediate tank unit sandwiched between two tank end units.

35. A catcher tank assembly for a waterj et cutting machine, the catcher tank assembly comprising:

a catcher tank including a plurality of tank sections, each tank section comprising opposing sidewalls and a floor extending therebetween that define one of opposing sides of a u-shaped mating interface that extends a full width of the catcher tank between adjacent tank sections, each u-shaped mating interface being provided with a respective sealing device in sealing contact with the adjacent tank sections, a number of the u-shaped mating interfaces of the catcher tank and a number of the sealing devices each being exactly one less than the number of tank sections, and the tank sections being detachably coupled together in a side-by-side manner to collectively define an internal tank cavity to hold a volume of water for absorbing energy of a jet generated by the waterjet cutting machine during a cutting operation, and the floors of the tank sections collectively defining a tank floor, wherein the respective sealing device is positioned within the internal tank cavity;

a workpiece platform that forms an upper work surface of the catcher tank upon which to support a workpiece to be processed during the cutting operation; and a workpiece support system detachably coupled to the tank floor, the workpiece support system including a plurality of workpiece support modules that are arranged in an array beneath the workpiece platform and that cooperatively support the workpiece platform, wherein the workpiece support system further includes a plurality of adjustment devices for selectively leveling the workpiece support modules to level the workpiece platform supported thereon.

36. The catcher tank assembly of claim 35 wherein the catcher tank is configured such that a first row of the array of workpiece support modules is detachably coupled to a first one of the tank sections and a second row of the array of workpiece support modules is detachably coupled to a second one of the tank sections, and wherein the first row and the second row of the array of workpiece support modules cooperatively support the workpiece platform.

37. The catcher tank assembly of claim 35 wherein the plurality of tank sections of the catcher tank include two tank end units and an intermediate tank unit, the plurality of tank sections being reconfigurable between a first tank configuration, in which the end tank units are detachably coupled together, and a second tank configuration, in which the end tank units are detachably coupled to opposing sides of the intermediate tank unit to provide an internal tank cavity larger than an internal tank cavity of the first tank configuration.

38. The catcher tank assembly of claim 35 wherein each of the plurality of tank sections of the catcher tank further includes a flange extending across one of the opposing sidewalls along the floor and across the other one of the opposing sidewalls to define the u-shaped mating interface for selectively assembling the tank sections in the side-by-side manner to collectively define the internal tank cavity.

39. The catcher tank assembly of claim 35 wherein each of the tank sections of the catcher tank includes an upstanding flange offset from an abutment edge, and wherein the sealing device of each u-shaped mating interface of the catcher tank is a cord compressibly disposed between the upstanding flanges of two adjacent tank sections.

40. The catcher tank assembly of claim 39 wherein the catcher tank further includes at least one spacer disposed between the upstanding flanges of the two adjacent tank sections to control a degree of compression of the cord.

41. The catcher tank assembly of claim 40 wherein the abutment edges, the upstanding flanges and the at least one spacer combine to define a box-like cavity that captively receives the cord.

* * * * *